United States Patent [19]

Andreas et al.

[11] Patent Number: 4,987,684

[45] Date of Patent: Jan. 29, 1991

[54] WELLBORE INERTIAL DIRECTIONAL SURVEYING SYSTEM

[75] Inventors: Ronald D. Andreas; G. Michael Heck; Stewart M. Kohler; Alfred C. Watts, all of Albuquerque, N. Mex.

[73] Assignee: The United States of America as represented by the United States Department of Energy, Washington, D.C.

[21] Appl. No.: 415,941

[22] Filed: Sep. 8, 1982

[51] Int. Cl.[5] ..... G01C 9/00

[52] U.S. Cl. ..... 33/304; 33/313

[58] Field of Search ..... 33/301, 304, 312, 313, 33/318, 321, 323; 73/151

[56] References Cited

U.S. PATENT DOCUMENTS

| | | | |
|---|---|---|---|
| 3,231,726 | 7/1966 | Williamson | 33/322 X |
| 3,862,499 | 1/1975 | Isham | 33/302 X |
| 4,071,959 | 2/1978 | Russell | 33/313 |
| 4,199,869 | 4/1980 | VanSteenwyk | 33/304 X |
| 4,238,889 | 12/1980 | Barriac | 33/304 |
| 4,244,116 | 1/1981 | Barriac | 33/318 X |
| 4,265,028 | 5/1981 | Van Steenwyk | 33/304 |
| 4,454,756 | 6/1984 | Sharp et al. | 33/313 X |

FOREIGN PATENT DOCUMENTS

| | | | |
|---|---|---|---|
| 558616 | 1/1944 | United Kingdom | 33/312 |

*Primary Examiner*—Harry N. Harovan

*Attorney, Agent, or Firm*—George H. Libman; James H. Chafin; William R. Moser

[57] ABSTRACT

A wellbore inertial directional surveying system for providing a complete directional survey of an oil or gas well borehole to determine the displacement in all three directions of the borehole path relative to the well head at the surface. The information generated by the present invention is especially useful when numerous wells are drilled to different geographical targets from a single off-shore platform. Accurate knowledge of the path of the borehole allows proper well spacing and provides assurance that target formations are reached. The tool is lowered down into a borehole on the electrical cable. A computer positioned on the surface communicates with the tool via the cable. The tool contains a sensor block which is supported on a single gimbal, the rotation axis of which is aligned with the cylinder axis of the tool and, correspondingly, the borehole. The gyroscope measurement of the sensor block rotation is used in a null-seeking servo loop which essentially prevents rotation of the sensor block aboutthe gimbal axis. Angular rates of the sensor block about axes which are perpendicular to the gimbal axis are measured by gyroscopes in a manner similar to a strapped-down arrangement. Three accelerometers provide acceleration information as the tool is lowered within the borehole. The uphole computer derives position information based upon acceleration information and anular rate information. Kalman estimation techniques are used to compensate for system errors.

11 Claims, 18 Drawing Sheets

FLOW CHART OF SURVEY ALGORITHMS

FLOW CHART FOR THE KALMAN ESTIMATOR

CLOCK AND Z ACCELEROMETER A/F BOARD (I/O MODULE)

WELLBORE INERTIAL DIRECTIONAL SURVEYING SYSTEM

The U.S. Government has rights in this invention pursuant to Contract No. DE-AC04-76DP00789 between the U.S. Department of Energy and Western Electric Company.

BACKGROUND OF THE INVENTION

The present invention relates to a tool which provides a complete directional survey of an oil or gas well borehole for determining the displacement of the borehole path in all three directions relative to the well head at the surface.

Most instruments or tools which are used to perform directional surveys include devices which measure the attitude, or angular orientation, of the tool as it is lowered on a cable into the borehole. Typically, accelerometers or tilt sensors are used to measure tool inclination and gyroscopic or magnetic compasses are employed to locate North. The displacement of the tool is calculated by projecting each incremental increase in cable length in the direction determined by the tool attitude. Displacement measurement errors are usually on the order of ten feet for each one thousand feet of borehole length and result from errors in the gravity and north sensing devices, and misalignment between the tool and the borehole. In addition, displacement measurement errors result due to inaccuracies in the cable length measurement.

Recently, efforts have been made to adapt aircraft inertial navigation systems for use as borehole directional surveying instruments. In an inertial navigation system the outputs of the accelerometers and gyroscopes are manipulated in a computer to provide velocity and displacement. No measurements of cable length are required.

Broadly speaking, two types of navigation system mechanization exists, namely, gimballed and strapped down. In a gimballed system, the sensor block containing the gyroscopes and accelerometers is supported by a set of gimbals which isolate the sensor block from rotation relative to the outer casing. In normal operation, the sensor block remains virtually rotationally motionless and maintains approximately its initial or referenced alignment. The outputs of gyroscopes on the sensor block are used in null-seeking servo loops which drive the gimbals so that no rotation of the sensor block occurs. An advantage of a gimballed system is that the gyroscopes are not required to measure large angular rates. The gyroscopes operate in a benign, nominally zero, angular rate environment. An important disadvantage of gimballed systems is high mechanical complexity.

A strapped-down system does not include gimbals. Any angular rate of rotation of the instrument casing within the borehole is transmitted directly to the sensor block. The gyroscopes must measure a wide range of angular rates from zero up to perhaps several hundred degrees per second. Strapped-down systems are mechanically simpler and usually smaller than gimballed systems.

Hithertofore, a number of borehole sensor devices have been developed which normally include a gyroscope and accelerometers to measure the attitude and a cable measurement device to determine the depth of the instrument within the borehole. For example, two patents issued to Van Steenwyk, U.S. Pat. No. 3,753,296 and U.S. Pat. No. 4,199,869, together with the Van Steenwyk et al. Patent, U.S. 4,197,654, disclose a well mapping apparatus which employs an attitude gyroscope mechanism. Each of these patents includes a suitable meter 17 which records the length of the cable extending downwardly in the well for logging purposes. In addition, each patent discloses a gyroscope 25 which is mounted on slip ring structures 25a and 26a being provided with terminals for transmitting signal outputs of the gyroscope and an accelerometer 26.

Barriac, U.S. Pat. No. 4,244,116, discloses a device for measuring the azimuth and the slope of a drilling hole. This device incorporates a gyroscope 5 and an accelerometer 12 which include two principle axes of sensitivity which are parallel with respect to each other. This device is designed only for measuring the attitude of a borehole.

Barriac, U.S. Pat. No. 4,238,889, discloses a device for scanning the azimuth and slope of a borehole. The device includes a gyroscope and an accelerometer which are suspended from a cable. The gyroscope and accelerometer are only for measuring the attitude of the mechanism within the borehole and a measuring means 6 is provided for measuring the length of the cable as the device is lowered into the borehole.

Armistead, U.S. Pat. No. 3,691,363, discloses a method and apparatus for directional logging of a borehole. A constant speed electric motor 11, for example, a synchronous motor, is mounted in an upper instrument casing 13 to rotate a first coil 10. The first coil 10 is positioned within a Helmholtz coil 40. The Helmholtz coil 40 is gimbally mounted to the upper instrument case 13 so that it maintains its central axis in a vertical orientation whereby the rotating inclined coil 10 is subjected to magnetic flux lines of a substantially vertical direction. A length measuring and pulse generating unit 119 is provided which is mechanically coupled with the sheave 114 and includes means for measuring each increment of cable length passing over the sheave 114 as the logging instrument is raised or lowered. The length measuring and pulse generating unit 119 issues a trigger pulse for each length increment measured.

The Grosso et al Patent, U.S. Pat. No. 3,982,431, and the Asmundsson et al Patent, U.S. Pat. No. 4,021,774, disclose borehole sensor devices. Each borehole sensor includes a three axis gimbal device for determining a vertical plane using the force of gravity as a reference, a horizontal plane using the force of gravity as a reference and a north direction using the magnetic field as a third axis reference. Both of these devices utilize mud which flows through the orifice 50 which creates pressure pulses in the mud stream which are transmitted to and sensed at the surface to provide indications of various conditions sensed by the sensor unit 44. The mechanisms disclosed in both of these patents are actually operative for a short period of time every thirty feet or so of depth of the borehole. The device disclosed in both of these patents is utilized to measure the attitude of the mechanism within the borehole.

Poquette, U.S. Pat. No. 4,245,498, discloses a well surveying instrument which provides incremental angular information about two axes normal to the axial center line of a well pipe to be surveyed. Tilt information is provided by a rate gyro positioned in azimuth by a null-seeking azimuth gyro on an azimuth gimbal. The depth of the device within the borehole is obtained by measuring the length of the cable paid out as the device is lowered into the borehole.

Starr, U.S. Pat. No. 4,302,886, discloses a gyroscopic directional surveying instrument. The subject matter set forth in the Starr Patent is primarily directed to protecting the instrument disposed within the outer casing of the device. More particularly, Starr provides a surveying instrument which can withstand pressure of 24,000 pounds per square inch. In addition, the device is designed to withstand temperature in the range of 450° F. The instrument disclosed by Starr includes a vacuum flask and a pressure vessel in which the instruments are disposed.

SUMMARY AND OBJECTS OF THE INVENTION

An object of the present invention is to provide an inertial borehole directional survey system which requires no cable length measurement.

Another object of the present invention is to provide a surveying system wherein displacements of the device within a borehole are obtained by an inertial navigation technique of calculating the attitude from gyro outputs and using this information to convert measured accelerations into accelerations in specific directions, for example, north, down, east, etc.

A further object of the present invention is to provide a surveying system wherein the instrument package-to-wellbore misalignment is not an error source. The path of the device through the wellbore is determined independently of the orientation of the device relative to the wellbore.

A further object of the present invention is to provide an inertial borehole directional surveying system which accurately calculates the path of the wellbore without being subjected to errors generated by cable length measurements and errors due to misalignment of the device within the wellbore.

Another object of the present invention is to provide a device for surveying a wellbore which includes a sensor block mounted on a single gimbal. The rotational axis of the gimbal is aligned with the cylindrical axis of the device.

Another object of the present invention is to provide a wellbore surveying device which uses inertial navigation techniques and which utilizes Kalman's filtering techniques to optimally predict system errors.

Still another object of the present invention is to increase the speed of wellbore surveying to decrease drilling downtime and reduce the system's susceptibility to overheating in deep and/or hot wellbores.

A further object of the present invention is to provide a device for surveying a borehole wherein the device is insensitive to spinning of the tool induced by cable twist or the action of borehole fluids or tool centralizers as the tool is raised or lowered in the borehole.

These and other objects of the present invention are achieved by providing an inertial borehole directional surveying system which includes two dual axis gyroscopes and three single axis accelerometers. These inertial sensors are located on a sensor block which is supported on a single gimbal. The rotational axis of the sensor block is aligned with the cylindrical axis of the tool. Utilizing the two dual axis gyroscopes and the three single axis accelerometers provides three axes of angular and linear motion measurements. One gyro axis is dedicated to a nullseeking servo loop which effectively eliminates sensor block rotation about the gimbal axis. Two other gyro axes are used to measure sensor block rotations about axes in a plane perpendicular to the gimbal axis. The remaining gyro axis is redundant.

This mechanization is a combination of the fully gimballed and strapped-down mechanizations previously mentioned. In this hybrid mechanization, the problem of measuring high rates of spin of the tool about its cylinder axis is eliminated, and system calibration is facilitated. Insulation is provided to lessen the effect of high formation temperatures on the outer surface of the tool. In addition, the tool includes gimbal servo and inertial sensor electronics and computer interface electronics. Displacements of the tool relative to the top of the borehole are obtained by calculating sensor block attitude from the gyro outputs and using this information to convert measured accelerations into accelerations in specific directions. The accelerations are doubly integrated to provide displacement information of the tool relative to the top of the wellbore. Instrument package-to-wellbore misalignment is not an error source since the path of the tool in the borehole is determined independently of the package orientation relative to the wellbore.

The device of the present invention further utilizes Kalman estimation techniques to compensate for system errors and optimize survey accuracy. The borehole instrument is periodically stopped in the borehole to monitor velocity calculation errors. Each stop may be extremely short in duration and is used to find actual velocity calculation errors for use in Kalman estimation. The device of the present invention through the use of its inertial surveying techniques may survey a borehole at extremely high rates: approximately 500 ft/min.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
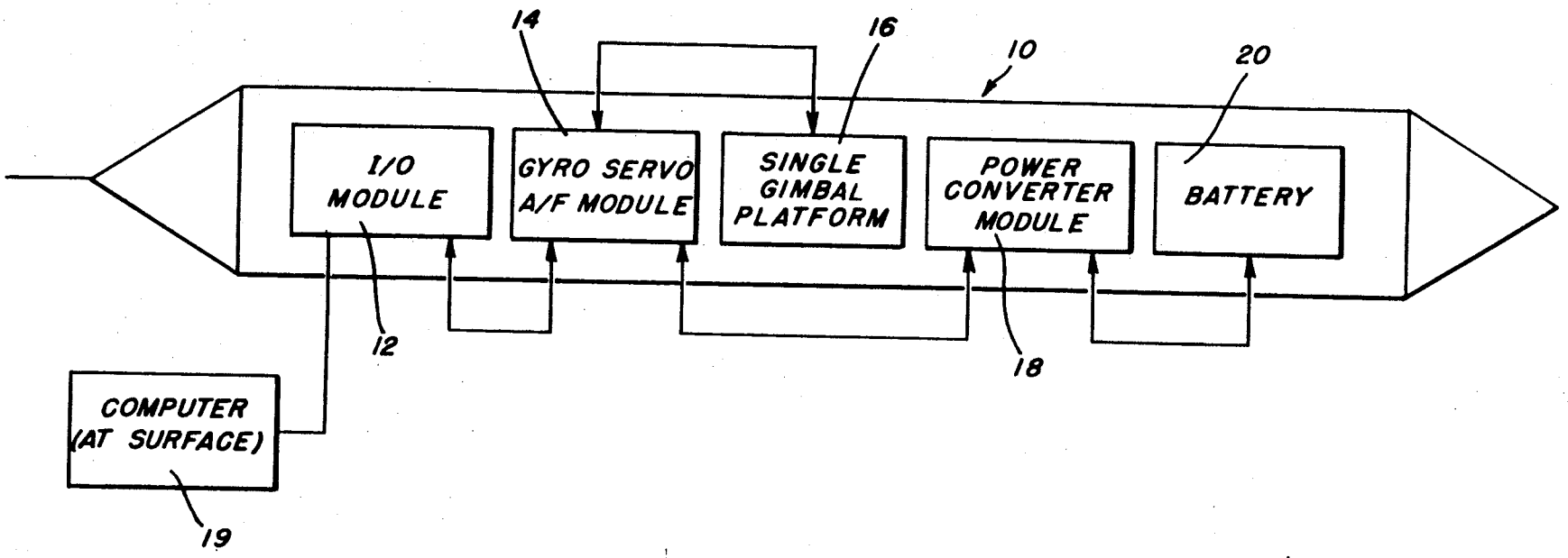
FIG. 1 is a block diagram view of the various components which form the inertial borehole directional surveying system.
Figure 2:
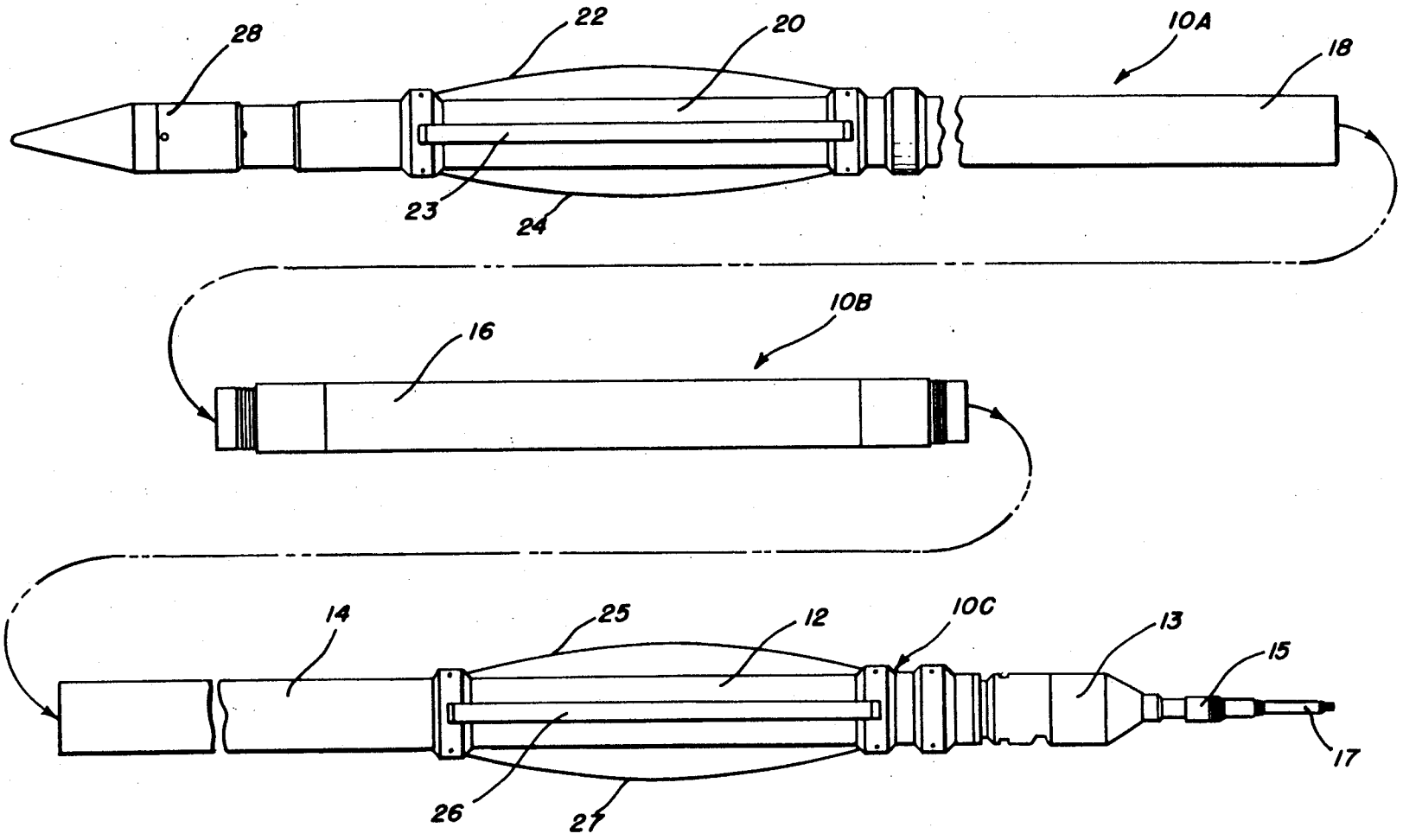
FIG. 2 is a disconnected side view showing the various components and the interconnection of the system.

Referring to FIGS. 1 and 2, the wellbore inertial survey system includes an outer housing 10 which may be disconnected into at least three sections 10A, 10B and 10C. The outer housing 10 may be constructed of stainless steel and includes an input/output module 12, a gyro analog-to-frequency converter and servo module 14, a single gimbal platform assembly 16, a power converter module 18 and a battery compartment 20. In addition, as illustrated in FIG. 2, the input/output electronics module 12 is connected by means of a lift plug 13 to a cable head 15. The cable head 15 is connected to a cable 17 which permits the outer housing 10 to be raised or lowered within a borehole. In addition, the cable 17 provides an electrical connection between the wellbore inertial survey system and a computer 19 which is positioned at the surface and communicates with the tool.

The battery pack 20 includes centralizers 22, 23 and 24 for stabilizing the position of the outer housing 10 within a borehole. Similarly, the input/ output electronics module 12 includes stabilizers 25, 26 and 27 which serve a similar function.

The lowermost portion of the outer housing 10 is a shock assembly 28 which is connected directly to the battery pack 20. The shock assembly 28 may contain a large spring to absorb some of the shocks which may occur during handling. In a preferred embodiment, the outer housing 10 may be four inches in outer diameter, approximately 20 feet long and have a wall thickness of 0.25 inches. The outer housing 10 has a pressure rating of approximately 10,000 pounds per square inch.

Figures 3, 3A, 3B:
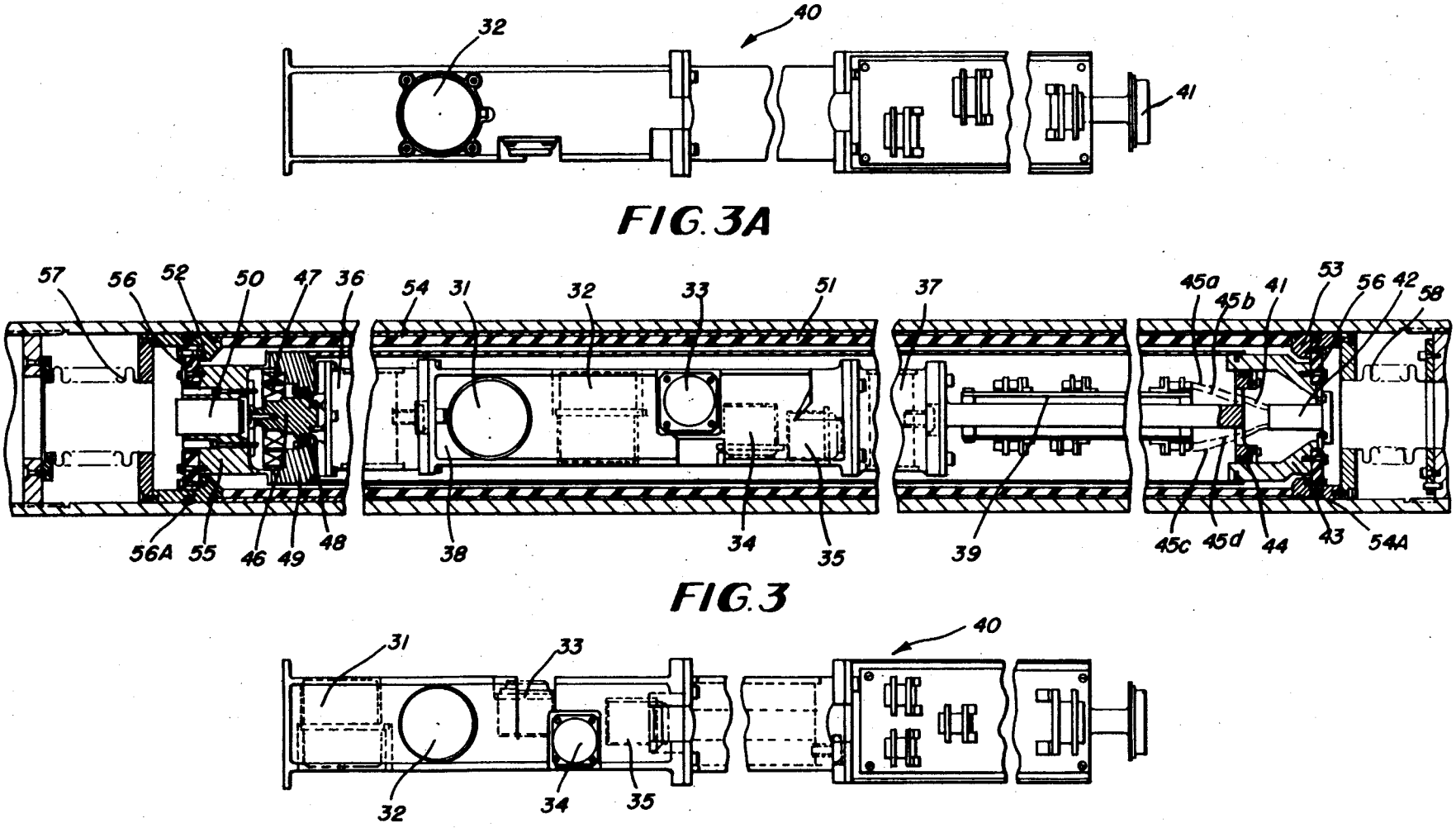
FIG. 3 is a cross-sectional view showing the internal portion of the single gimbal platform.
FIG. 3A is a top plan view of the inertial sensor block or platform as shown in FIG. 3.
FIG. 3B is a bottom view of the inertial sensor block or platform as shown in FIG. 3.

The single gimbal platform assembly 16 is more clearly illustrated in the partial cross-sectional view shown in FIG. 3 and includes two Incosym Model III-E tuned rotor dual axis gyros 31 and 32. In addition, three Sundstrand QA-1200 single axis accelerometers 33, 34 and 35 are used. Two heat sinks 36, 37 are positioned one on each side of the platform 38 on which the gyroscopes and accelerometers are mounted. Sensor electronics and connectors are mounted on a platform 39 which is affixed to one end of the heat sink 37.

As illustrated in FIG. 3A and 3B, the sensor block 40 includes an end connector 41. Referring to FIG. 3, the end connector 41 is mounted within an outer casing 43 which is affixed to the outer housing 10. Bearings 44 are positioned between the outer end member 41 and the outer casing 43 to permit relative rotation therebetween. The electronic components positioned on the platform 39 are connected by means of wires 45*a*, 45*b*, 45*c* and 45*d* to a slip ring 42. The slip ring 42 is mounted relative to outer casing 43.

Similarly, the heat sink 36 is mounted to a protruding shaft 46 which is disposed within the gimbal motor 47. Bearings 48 are positioned between the protruding shaft 46 and the end casing 49 which is affixed to the outer housing 10. A gimbal motor 47 is disposed between the end casing 49 and the protruding shaft 46. A resolver 50 is operatively connected to the protruding shaft 46 to measure the gimbal angle relative to the pressure barrel position.

An insulation layer 51 is connected to end members 52, 53. A protecting cover 54 is mounted on the exterior portion of the insulation layer 51 and is similarly affixed to the end members 52, 53. The end member 53 is connected to the outer casing member 43 by means of a vibration isolator 56. Similarly, the end member 52 is connected to a housing member 55 by means of a vibration isolator 56. In addition, shock absorbers 57, 58 are affixed to the end members 52, 53 to prevent damage to the components positioned on the sensor block 40.

The two printed circuit boards positioned on the platform 39 contain gyro heater control circuitry and gyro preamp circuitry. The gimbal motor 47 produces a torque in response to the gyro output to counteract bearing friction and allow the sensor block 40 to remain essentially motionless in the presence of tool rotation about the longitudinal axis. The resolver 50 measures the gimbal angle relative to pressure barrel position.

Figure 4:
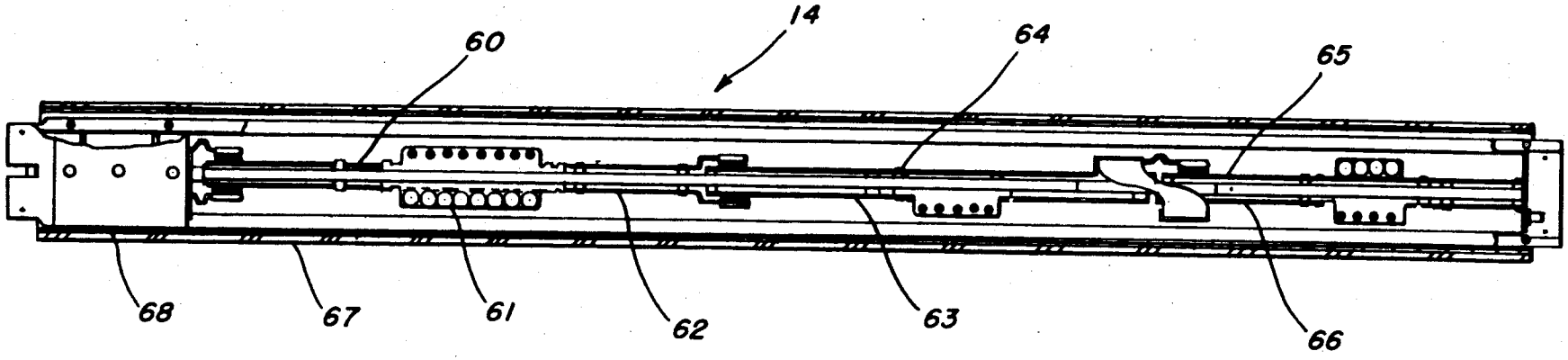
FIG. 4 is a top plan cross-sectional view showing the gyro servo and analog-to-frequency (A/F) electronics module of the system.
Figure 5:
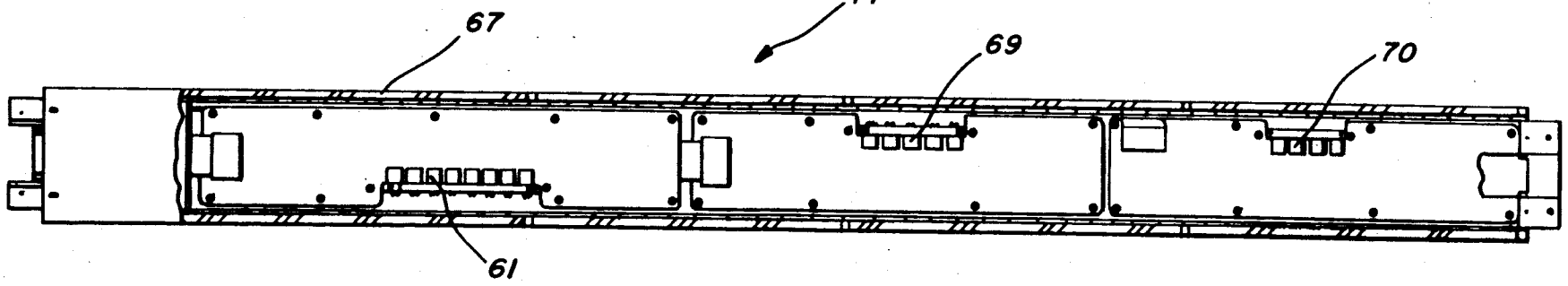
FIG. 5 is a side cross-sectional view showing the gyro servo and A/F electronics module illustrated in FIG. 4.

As illustrated in FIGS. 4 and 5, a gyro servo, analog-to-frequency converter (A/F) module 14 includes a $X_R$-Z gyro A/F electronics 60, a X-Y gyro A/F electronics 62, a X-Y accelerometer A/F electronics 63, a signal distribution circuit 64, a $X_R$-Z gyro servo 65 and a X-Y gyro servo 66. The $X_R$-Z gyro A/F electronics 60 and the X-Y gyro A/F electronics 62 contain a heat sink 61. An insulation layer 67 is positioned around the outer circumference of the gyro servo, A/F module 14. An interconnection package 68 is positioned at one end of the gyro servo, A/F module 14 for connection to the input/output module 12. The X-Y accelerometer A/F electronics 63 is connected to a heat sink 69. Similarly, the $X_R$-Z gyro servo 65 and the X-Y gyro servo 66 are connected to a heat sink 70.

The input/output module 12, the gyro servo, A/F module 14 and the power converter module 18 include circuit boards attached to each side of an aluminum plate. The gyro servo, A/F module 14 has been discussed hereinabove. The aluminum plate forms not only a structural support, but also provides a heat sink for high power electric components.

Figure 22:
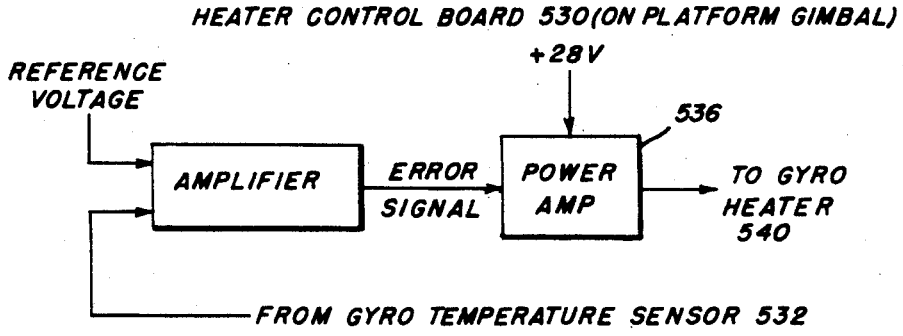
FIG. 22 is a block diagram of the Heater Control Board of the system.

The two gyroscopes are the only elements of the system which include active temperature control means. Heaters and a temperature sensor are mounted on each gyro and function in conjunction with temperature control electronics to bring the gyros to a controlled temperature of 160° F. or 71° C. within 10 minutes after the system is turned on. The temperature control electronics are illustrated by the heater control board 530 of FIG. 22. The temperature of each gyro is sensed by an associated sensor 532 (not shown). This temperature is compared with a reference voltage by a difference amplifier 534 to produce a difference signal which is applied to a power amplifier 536 which in turn drives the gyro heater 540. There is one of these heater control circuits for each of the two gyros. Other temperature-sensitive components include the accelerometers and the analog-to-frequency converters. The temperatures of these elements are monitored so that compensation may be provided in the software of the computer, if necessary.

The majority of the electronic components of the system are off-the-shelf commercial items which have an advertised operating temperature limit of 125° C. In extremely deep boreholes, the temperature of the geological formations may easily exceed this limit. As discussed above, it is preferred to position insulation between the inner wall of the pressure barrel and the outer surface of the instrument. The insulation ray be a silicone foam rubber. This material has an advantage in that it is relatively inexpensive, relatively available and is capable of withstanding temperatures in excess of 200° C. In addition to external formation heat, a surveying tool must contend with internally generated heat.

Therefore, the temperature capability of the tool is also effected by the heat capacity of the tool contents. Fluids, ceramic-filled urethane foams, and ceramic sand are substances which may be used to fill voids in the electronics packages and to raise the thermal mass. Sand may be the preferred substance because of the ease of removal from the package if repair is needed. A relatively high thermal conductivity will result in a distribution of heat away from the hot spots so that the length of time before excessive temperatures are reached at any particular spot may be extended. However, the seriousness of this problem is lessened by the high survey rate produced by the device of the present invention. Temperatures at fifteen locations along the length of the tool are monitored, and power is shut off if the tool overheats.

Referring to FIG. 3, the vibration isolators 54, 56 reduce high frequency vibrations which might interfere with the sensor block 40. The isolators 56 are cut from a sheet of silicone foam rubber and are clamped between aluminum rings. In addition, the entire platform assembly is suspended by two shock absorbers 57, 58 which are formed from a metal bellows. O-rings 54A, 56A are provided along the assembly to provide a damping through friction with the pressure barrel. The centralizers on the pressure barrel provide radial shock and vibration isolation when the tool is in a wellbore.

Referring to FIGS. 3, 4 and 5, the gyro servo, A/F electronics module 14 contains an X-Y gyro servo board 65, a $X_R$-Z gyro servo board 66, a X-Y gyro A/F board 63, a $X_R$-Z gyro A/F board 60 and a X-Y accelerometer A/F board 63. Each of the two gyros 31, 32 on the platform 38 possesses two input axes. One X-Y gyro input axis is parallel to the gimbal axis of rotation, the X direction. The Y axis is pointed in a perpendicular direction relative to the X axis. The $X_R$-Z gyro axis $X_R$ is a redundant axis in the X direction. Each gyro contains a torquer which is used to precess the spinning wheel so that it follows sensor block rotation. The torquer current is nominally proportional to the angular rate about the gyro input axis.

A servo board 65, 66 for each gyro contains the circuitry which generates the proper torquer current. An X-Y Gyro Servo Board will be later described in the "Description of the Control Circuitry".

Figure 6:
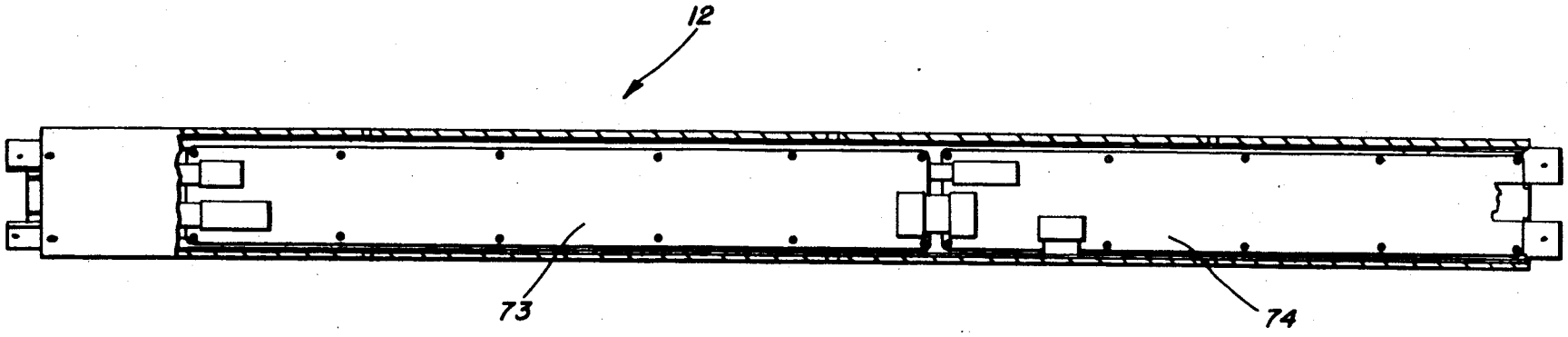
FIG. 6 is a top plan partial cross-sectional view showing the Input/Output (I/0) electronics module of the system.
Figure 7:
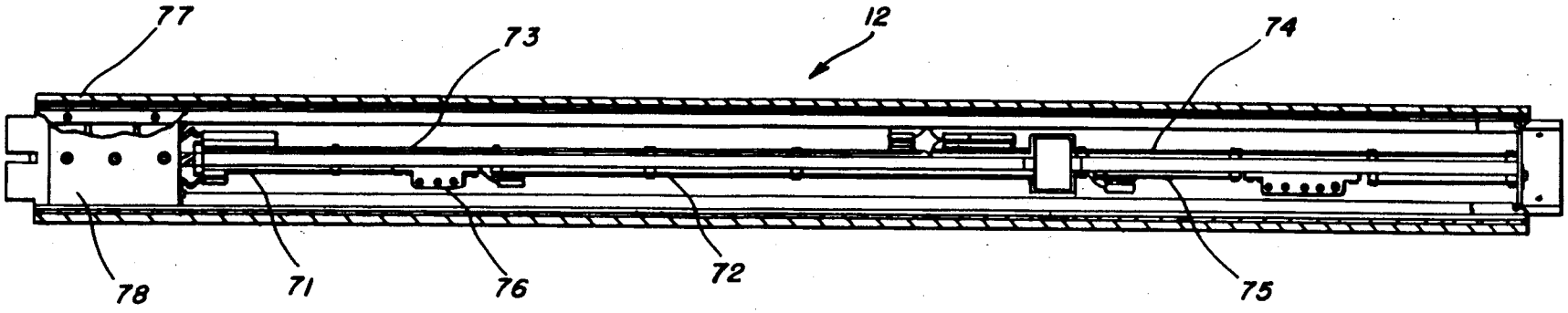
FIG. 7 is a side view of the I/0 electronics module according to FIG. 6.

As illustrated in FIGS. 6 and 7, an input/output electronics module 12 includes a clock and Z accelerometer A/F board 71, an analog-to-frequency (A/F) counter board 72, a resolver-to-digital (R/D) converter board 73, a central processor unit (CPU) board 74 and a line driver board 75. The clock and Z accelerometer A/F board 71 and the A/F counter board 72 include a heat sink 76. Insulation member 77 is disposed around the outer peripheral surface of the input/output electronics module. An interconnection package 78 is provided to connect the input/output electronics module to the gimbal servo, A/F electronics module 14.

Figure 8:
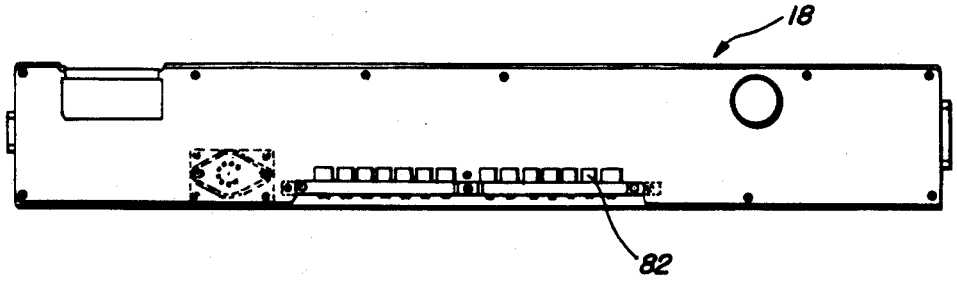
FIG. 8 is a top plan cross-sectional view of the power converter of the system.
Figure 9:
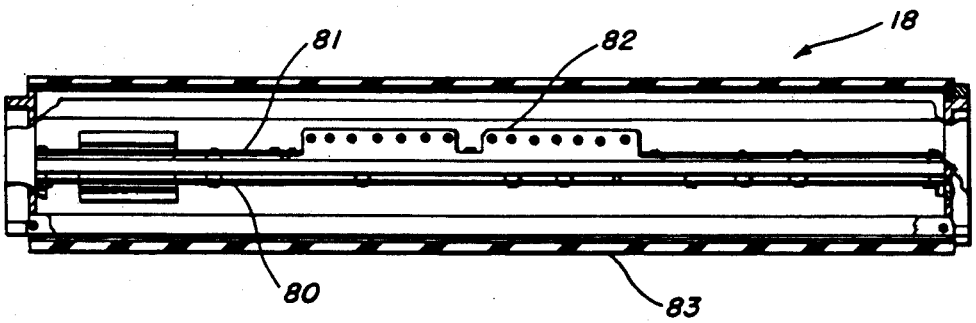
FIG. 9 is a side view of the power converter illustrated in FIG. 8.
Figure 18:
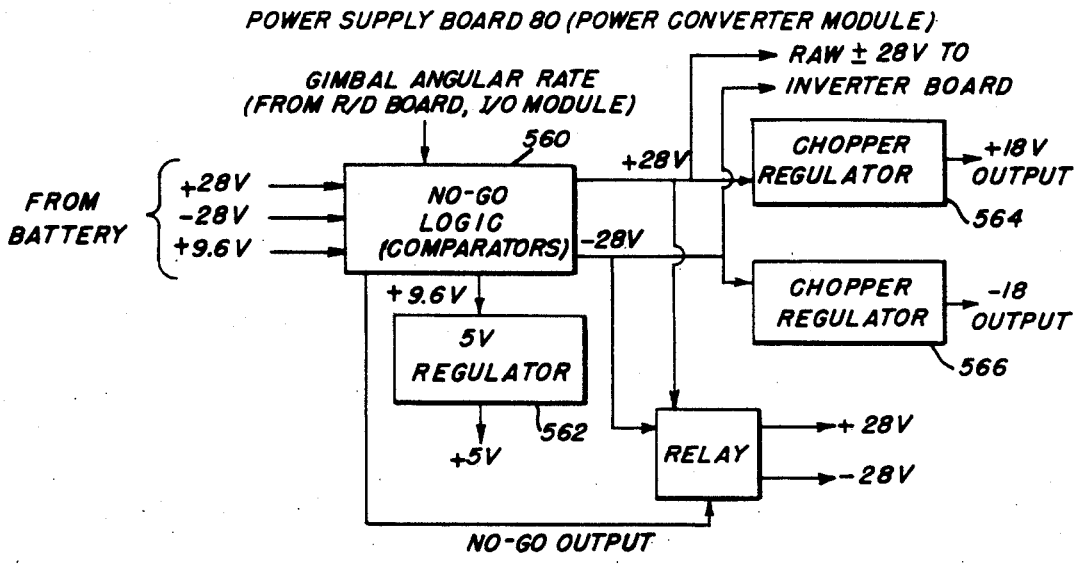
FIG. 18 is a block diagram of the Power Supply Board of the system.

Referring to FIGS. 8 and 9, the power converter 18 includes a power supply board 80 and an inverter board 81. The power supply board 80 provides D.C. power while the inverter board 81 converts this D.C. power into A.C. A heat sink 82 is operatively connected to the inverter board 81. Insulation 83 is disposed around the outer peripheral surface of the power converter 18. The power supply board 80 takes the raw +28V, −28V and the +9.6V power from the battery module and outputs +28V, −28V, +18V, −18V and +15V D.C. voltage levels. The power supply board 80 includes circuitry shown in FIG. 18 of the present specification. The +28V, −28V and +9.6V lines are presented to a no-go logic comparator. The no-go logic comparator is further provided with the Gimbal Angular Rate Signal produced by the signal conditioner 204 of the resolver/-digital board 15 of FIG. 20, to be later described. When a large gimbal angular rate is detected, the no-go logic comparator 560 disconnects the voltage to the platform gimbal motor by application of signal to a relay 566 to prevent uncontrolled platform spin-up which could damage the gyros. The relay 566 disconnects the +28V lines applied to the platform gimbal motor 72. A 5V regulator 562 is further provided on the power supply board 15 to produce a regulated logic power supply while first and second chopper regulators 564, 566 regulate the 28V to produce a +18V output.

Figure 10:
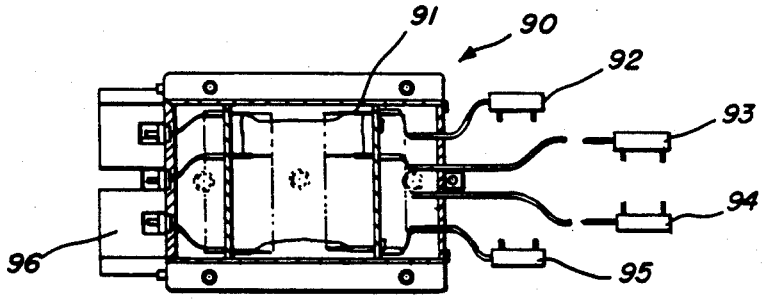
FIG. 10 is a top plan cross-sectional view of the interconnect package of the system.

Referring to FIG. 10, an interconnect package 90 is illustrated which electrically connects the gyro servo A/F module 14 with the input/output electronics module 12. Each interconnect package contains two boards holding 153 wire wrap/solder pot pins. All interconnections are accomplished by wire-wrapping to other pins on the same board in the case of entering signals which go out again through another connector or to pins on the opposite board if the signal is required inside the module.

The interconnect package 90 includes a wire-wrap pin 91 which is operatively connected to DIP, dual inline pin jumper 92 which interconnects a portion of the gyro servo A/F module 14 with the input/output module 12. In addition, the interconnect package includes DIP jumpers 93, 94 and 95. Further, a minature metal shell connector 96 is provided.

Figure 11:
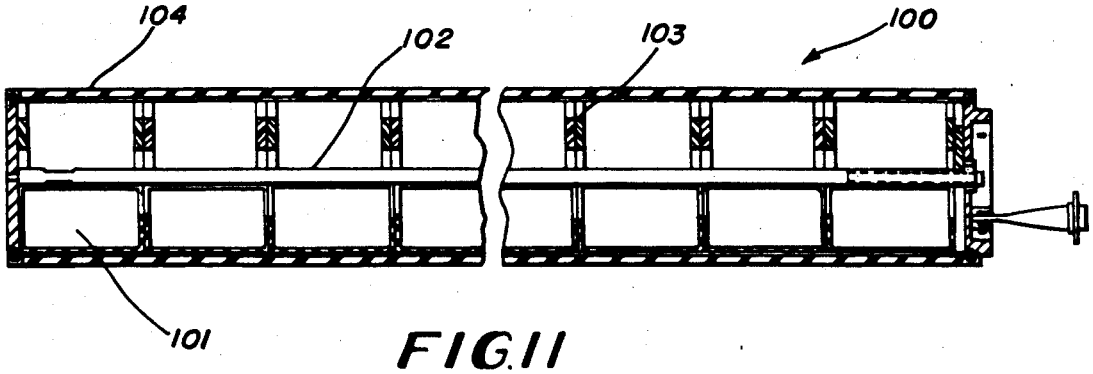
FIG. 11 is a top plan cross-sectional view of the battery pack of the system.

As illustrated in FIG. 11, a battery pack 100 includes 56 D size, 1.2V, 4 amp-hour, rechargeable NiCad batteries. The +28V and −28V supplies each consist of 24 batteries connected in series and the 9.6V supply contains the remaining 8 batteries. Estimated average power drain from each supply is about 1 amp, so the battery module 100 is capable of providing power for four hours of tool operation.

The battery pack module 100 includes a plurality of batteries 101 disposed in operative connection relative to each other. A clamping rod 102 ensures the accurate positioning of the plurality of batteries relative to each other. A Phenolic spacer 103 is disposed between predetermined batteries arranged within the battery pack 100. Insulation member 104 is provided around the outer peripheral surface of the battery pack.

DESCRIPTION OF THE CONTROL CIRCUITRY OF THE PRESENT INVENTION

Figure 16:
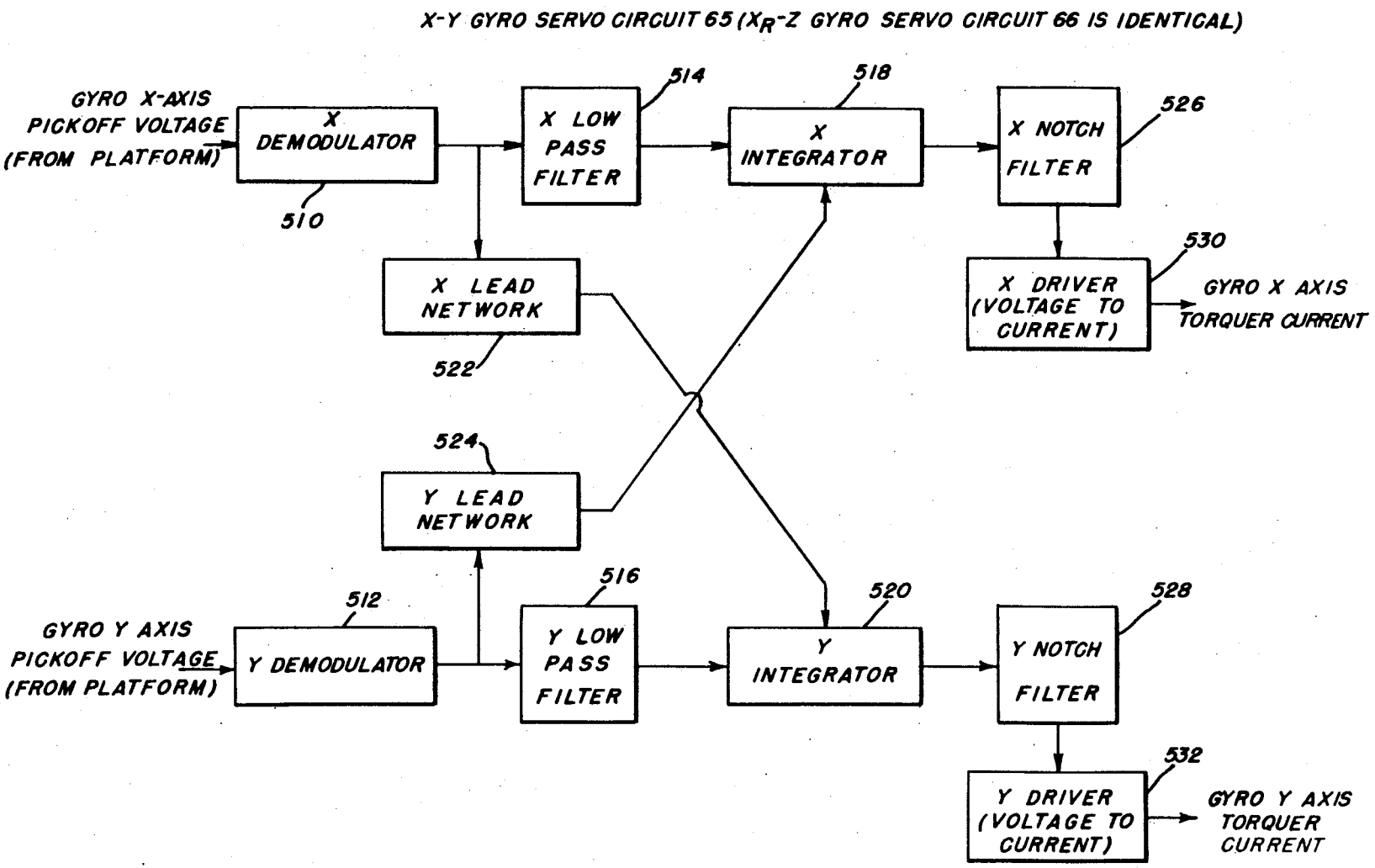
FIG. 16 is a block diagram of the X-Y Gyro Servo Board of the system.
Figure 23:
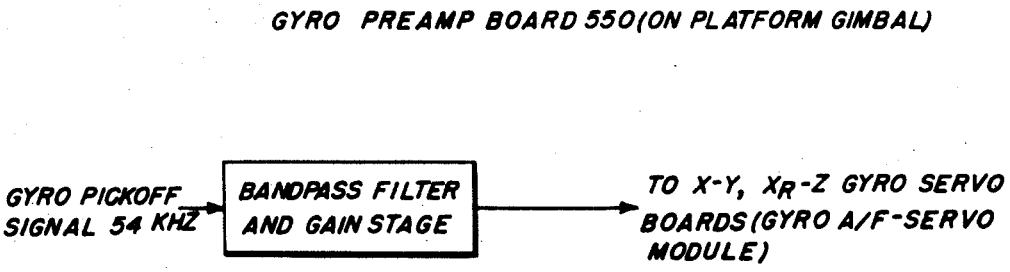
FIG. 23 is a block diagram of the Gyro Preamp Board of the system.

Referring to FIG. 16, the X-Y gyro servo circuit 65 is illustrated. This circuit generates gyro torquer currents from gyro pickoff voltages. The gyro torquer current is proportional to the angular rate of change of the platform gimbal 16 about the gyro input axis. FIG. 23 shows the Gyro Preamplifier Board 550 which receives and filters the Gyro Pickoff Signal from each gyro sensor, bandpass filters and amplifies the signal in a filter and gain stage 552 and presents an analog A.C. signal to the X-Y and X gryo servo circuits 65, 66 respectively. The pickoff voltages are produced by sensors mounted on the gyroscope gimbals. In one preferred embodiment, a resolver transformer type pickoff is used to produce each pickoff voltage.

The X axis gyroscope pickoff voltage from the gyroscope platform 16 is applied to the input of an X demodulator 510 which converts the alternating current gyroscope pickoff voltage into a voltage signal representative of a change of the angle of the system about the X axis. Similarly, a Y axis gyroscope pickoff voltage is produced from another resolver transformer type pickoff and produces an AC voltage which is demodulated by a Y demodulator 512 which produces a voltage representative of a change of the system angle about the Y axis. The voltage produced by the X demodulator 510 is passed to an X low pass filter 514 which functions to reduce signal noise. Similarly, a Y low pass filter 516 performs the same function on the output of the Y demodulator 512. The outputs of the respective low pass filters 514, 516 are then passed to an X integrator 518 and Y integrator 520, respectively, which function as second order filters having slightly underdamped characteristics which further serve to define the voltages representative of the angular change in the system about the X and Y axes, respectively. An X lead network 522 operating as the differentiator also receives the output of the X demodulator 510 and applies it as an input to the Y integrator 520 to compensate for precession created interaxis effects. This compensation takes the form of torquer axis rate feedback.

The outputs of the X integrator 518 and Y integrator 520 are respectively applied to an X notch filter 526 and Y notch filter 528 which aid in filtering out the natural harmonics caused by the gyroscope's spin frequency and pickoff resolver excitation frequency which produce noise within the system. The voltage outputs produced at the output of the respective notch filters 526, 528 are then applied to an X voltage to current driver 530 and Y voltage to current driver 532, respectively, which produce currents proportional to the voltages applied thereto. These currents are therefore, proportional to the respective angles.

While FIG. 16 illustrates the X-Y gyro servo circuit 65, it should be appreciated that the $X_R$-Z gyro servo circuit 66 is identical. Thus, this circuit is not independently described in the present specification.

Figure 15:
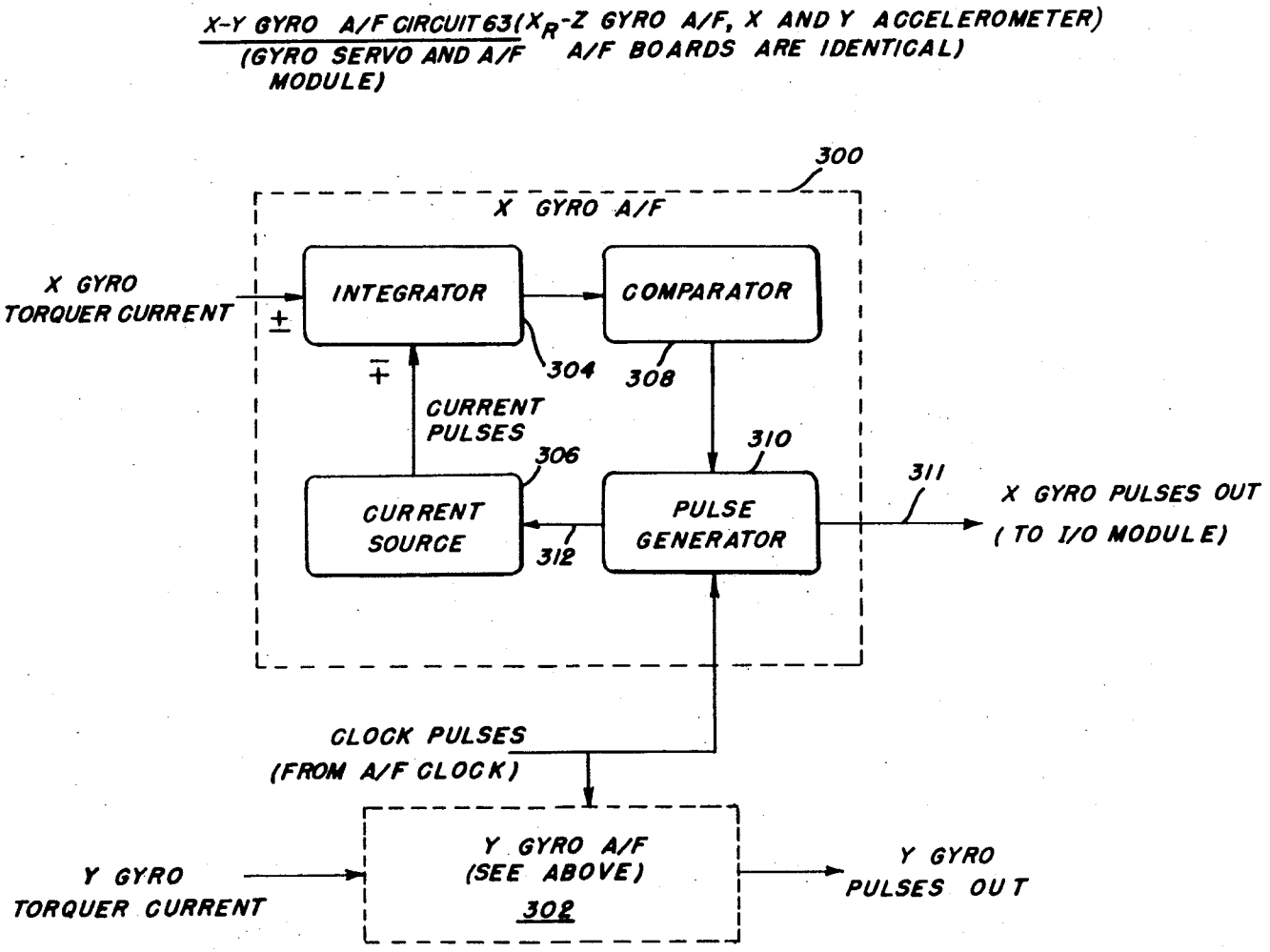
FIG. 15 is a block diagram showing the X-Y Gyro A/F Board of the system.

The outputs of the X driver 530 and Y driver 532 take the form of gyro X axis and Y axis torquer currents which are applied to the respective inputs of an X gyro A/F circuit 300 which is a part of the X-Y gyro A/F circuit 63 shown in FIG. 15.

These currents are applied to the respective gyro torquers. The resulting torques act to prevent tilts (pickoff angles) of the gyro wheel relative to the gyro case. According to the laws of gyrodynamics, the amount of torque, and therefore current, required to accomplish this is proportional to the angular rate of the gyro case (and the platform gimbal) about the respective gyro input axis.

The X-Y gyro A/F circuit (generally indicated as 63) functions to convert the analog gyro torquer currents into digital pulse trains having a pulse frequency proportional to the magnitude of the gyro torquer current. Thus, these gyro analog-to-frequency circuits digitalize the angular rate of change signal produced by the gyro servo circuits as described in FIG. 16. The X gyro A/F circuit 300 is exemplary of these analog-to-frequency converter circuits. An integrator 304 receives the X gyro torquer current produced by the X-Y gyro servo circuit 66. The integrator is a current-boosted operational amplifier with capacitor feedback. The integrator 304 integrates this rate current signal to produce a ramp wave form which is compared with a constant by a comparator 308. When the ramp type wave form generated by the integrator 304 is equal to the constant it is compared to in the comparator 308, the comparator 308 produces an equivalence signal which causes a pulse generator 310 to produce a pulse at its output 311. Simultaneously, the pulse generator produces a pulse at its output 312 which is applied to a current source 306 which converts the pulse generated by the pulse generator 310 into a current pulse which is applied to the integrator 304 to reset the integrator and start the ramp-up output of the integrator at zero. Thus, a new ramp-up waveform is compared with a constant by the comparator 308. This procedure continues with a pulse being produced each time the integrated gyro torquer current reaches a predetermined level. The net result is the production of a pulse train having a rate which is proportional to the X gyro torquer current applied to the integrator 304. Because this pulse rate produced at the output 311 of the pulse generator 310 is proportional to the angular rate of change sensed by the system, each individual pulse is proportional to a particular angular increment about the X axis. In a preferred embodiment, one pulse is equal to 1/600 of a degree.

The pulse generator 310 is supplied clock pulses from the clock 375 (FIG. 14) in order to control the pulse width of the pulses produced by the pulse generator 310.

Figure 21:
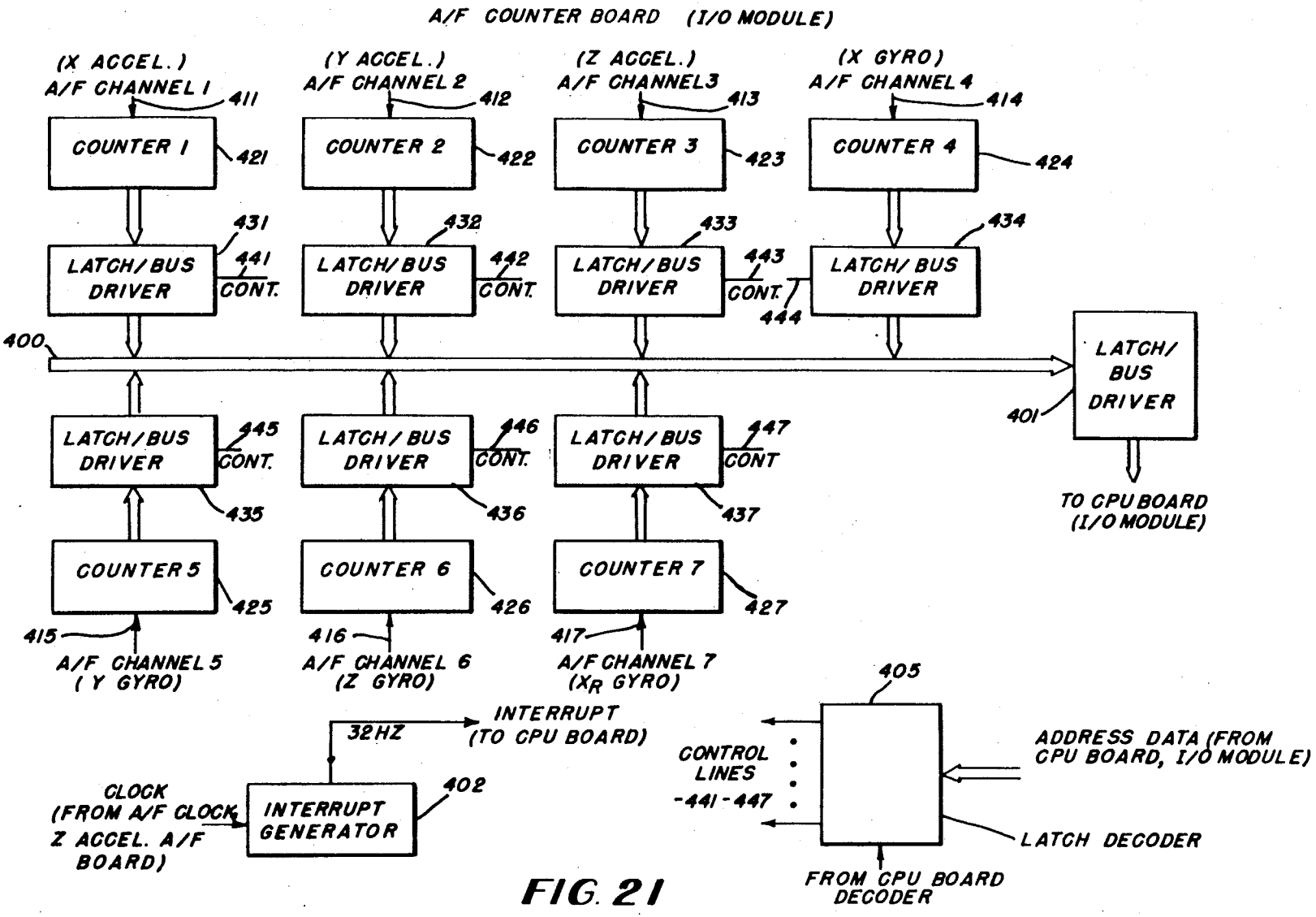
FIG. 21 is a block diagram of the A/F Counter Board of the system.

The Y gyro A/F circuit 302 is constructed identically to the X gyro A/F circuit 300. This circuit receives the Y gyro torquer current from the X-Y gyro servo circuit 66 and produces a Y gyro pulse train out at its output which, in conjunction with the X gyro pulse train out is applied to the I/0 module (FIG. 21).

The $X_R$-Z gyro A/F circuit 60 is structurally identical to the X-Y gyro A/F circuit 63. This circuit receives the $X_R$ gyro torquer current and Z gyro torquer current from the $X_R$-Z gyro servo circuit 66 and produces pulse trains to be applied to the I/0 module of FIG. 21 in a manner identical to the X-Y gyro A/F circuit 63.

Figure 14:
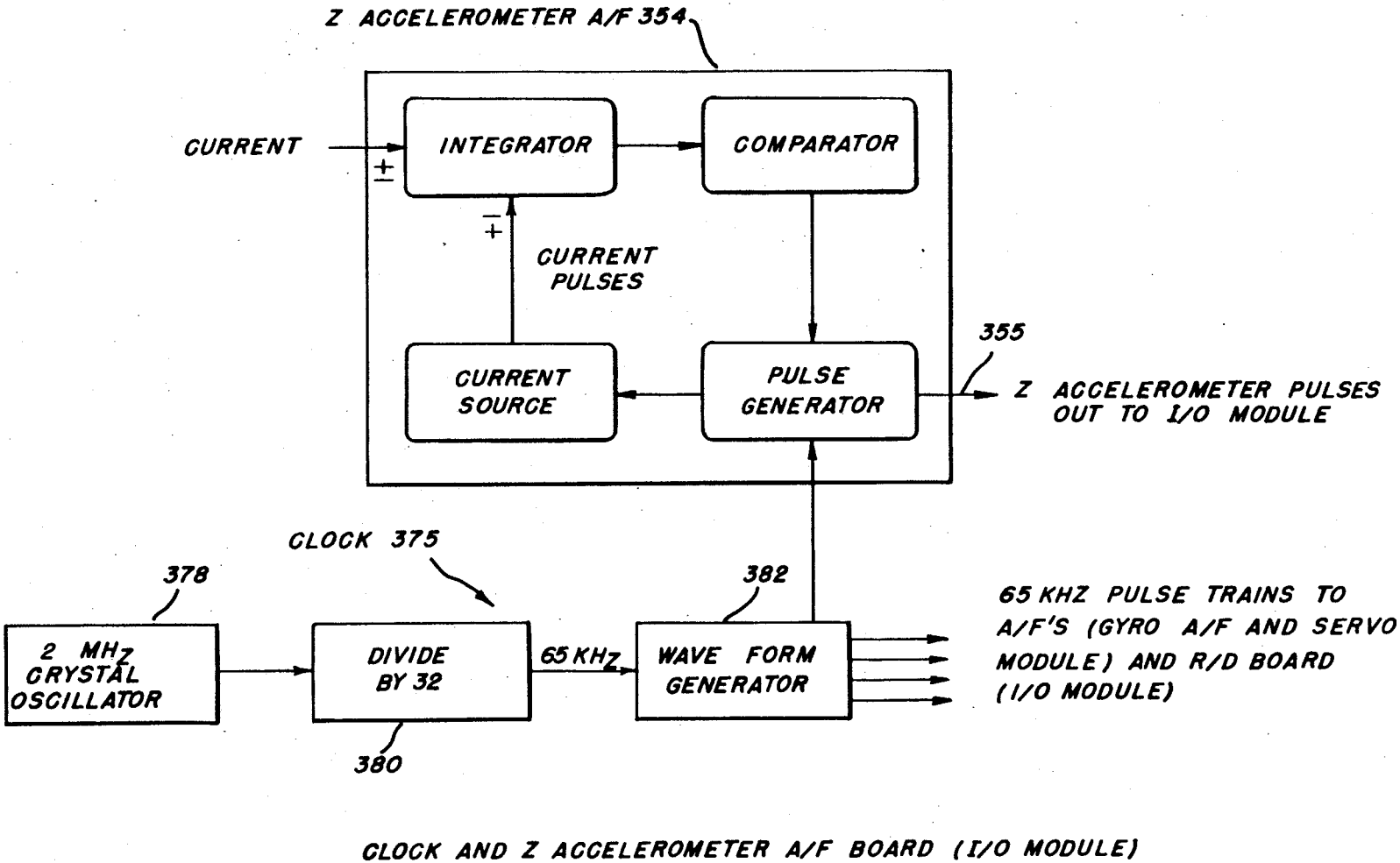
FIG. 14 is a block diagram showing the analog-to-frequency (A/F) Clock and Z Accelerometer analog-to-frequency (A/F) Board of the system.

FIG. 14 illustrates collectively a Z accelerometer A/F circuit 354 and the clock 375. The Z accelerometer A/F circuit 354 is identical to an X accelerometer A/F circuit 350, and a Y accelerometer A/F circuit 352. The three accelerometer A/F circuits receive currents from the X, Y, and Z accelerometers 33, 34, 35 as shown in FIG. 3. The current produced by each of these respective accelerometers is proportional to the rate of change of velocity of the system of the present invention. These rate of velocity change currents are applied to a Z accelerometer analog-to-frequency converter circuit 354 which is identical in every respect to the X gyro A/F circuit 300 described with respect to FIG. 15. The output 355 produced by the exemplary Z accelerometer A/F circuit is a pulse train of frequency proportional to the rate of change of velocity. These pulses are also provided to the input/output modules as described in FIG. 21.

The pulse width of the pulses is controlled by the clock 375 also illustrated in FIG. 14. The clock 375 comprises a crystal oscillator 378 which applies a two megahertz signal to a divide by 32 counter 380 which produces a 65 kilohertz at its output. This signal is applied to a waveform generator 382 which produces a 65 kilohertz pulse train which is applied to the analog/frequency circuits 300, 302, 324, 326, 350, 352, and 354. The clock pulses are also applied to an interrupt generator 402 of FIG. 21 and to the resolver/digital circuitry of FIG. 22.

An A/F counter circuit portion of the input/output module is illustrated in FIG. 21 of the present application. The X gyro pulse train output on line 311 from the X gyro A/F circuit 300 (FIG. 15) is applied to the X gyro input channel 414 of the A/F counter board of FIG. 21. Similarly, the Y gyro pulse train output produced by the Y gryo A/F circuit 302 is applied to the Y gyro input channel 415 of 10 the same board. The output of the $X_R$ redundant gyro A/F circuit 324 is applied to the $X_R$ gyro input channel 417 while the output of the Z gyro A/F circuit 326 is applied to the Z gyro input channel 416. Thus, the digital rate of angular change signals produced by the respective gyro A/F circuits are applied on lines 414–417. Similarly, the Z accelerometer pulse train out produced on line 355 by the Z accelerometer A/F circuit 354 is applied to the Z accelerometer input channel 413. The output of the X accelerometer A/F circuit 350 is applied to the X accelerometer input channel 411 while the output of the Y accelerometer A/F circuit 352 is applied to the Y accelerometer input channel 412.

A plurality of accumulator counters 421–427 accumulate pulses applied on the respective input channels 411–417. Each of these accumulator counters 421–427 present an output to an associated latch/bus driver 431–437. The latch/bus drivers 431–437 are each provided with a control signal on a respective control line 441–447. The signals presented on the respective control lines are presented by a latch decoder 405 which generates control signals in order to dump the contents of the respective accumulator counters 421–427 onto a data bus 400. The data bus 400 is controlled by an additional latch/bus driver 401 which passes the data to the CPU Board (FIG. 24).

Figure 24:
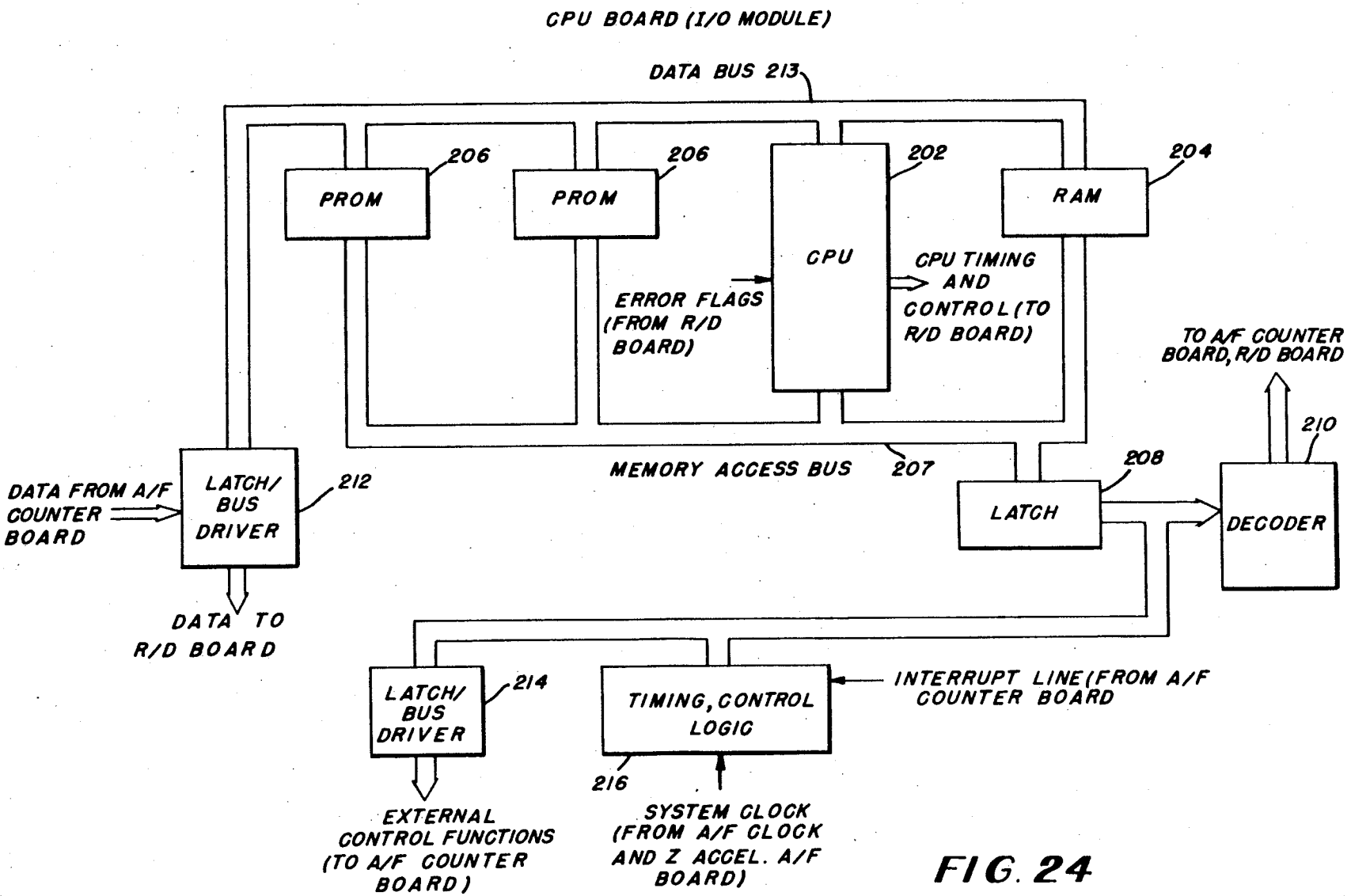
FIG. 24 is a block diagram of the Central Processing Unit (CPU) Board of the system.

Each time a latch/bus driver, for example, the latch/bus driver 431 associated with the X accelerometer channel, has a control signal applied via control line 441, the contents of this respective accumulator counter 421 are serially provided to the data bus 400 for transmittal to the CPU Board (FIG. 24). The respective accumulator counter 421 is then reset to again begin accumulating pulses produced by its respective X accumulator A/F circuit 350. The latch decoder 405 sequentially dumps the contents of the respective accumulator counters 421–427 on a periodic basis in order to provide acceleration and angular change information to the CPU Board (FIG. 24). Since each pulse produced by the X, Y, $X_R$ and Z gyro A/F circuits 300, 302, 324, 326 is representative of an increment of angular change, the number of pulses accumulated in the respective accumulation counters 424–427 are indicative of the angular change measured by the system. As the counts accumulated in the accumulator counters are accessed at periodic intervals, the rate of angular change may also be determined.

The acceleration signals produced by the X, Y and Z accelerometer A/F circuits 350, 352, 354, produce acceleration information which is accumulated in the accumulator counters 421–423 and also presented to the CPU Board via data bus 400 and latch/bus driver 401.

FIG. 21 also illustrates an interrupt generator 402 which receives clock signals from the clock 375 (FIG. 14) and provides these signals to the CPU Board in order to aid the CPU Board in the generation of signals to control the sample rate produced by the latch decoder 405.

Figure 20:
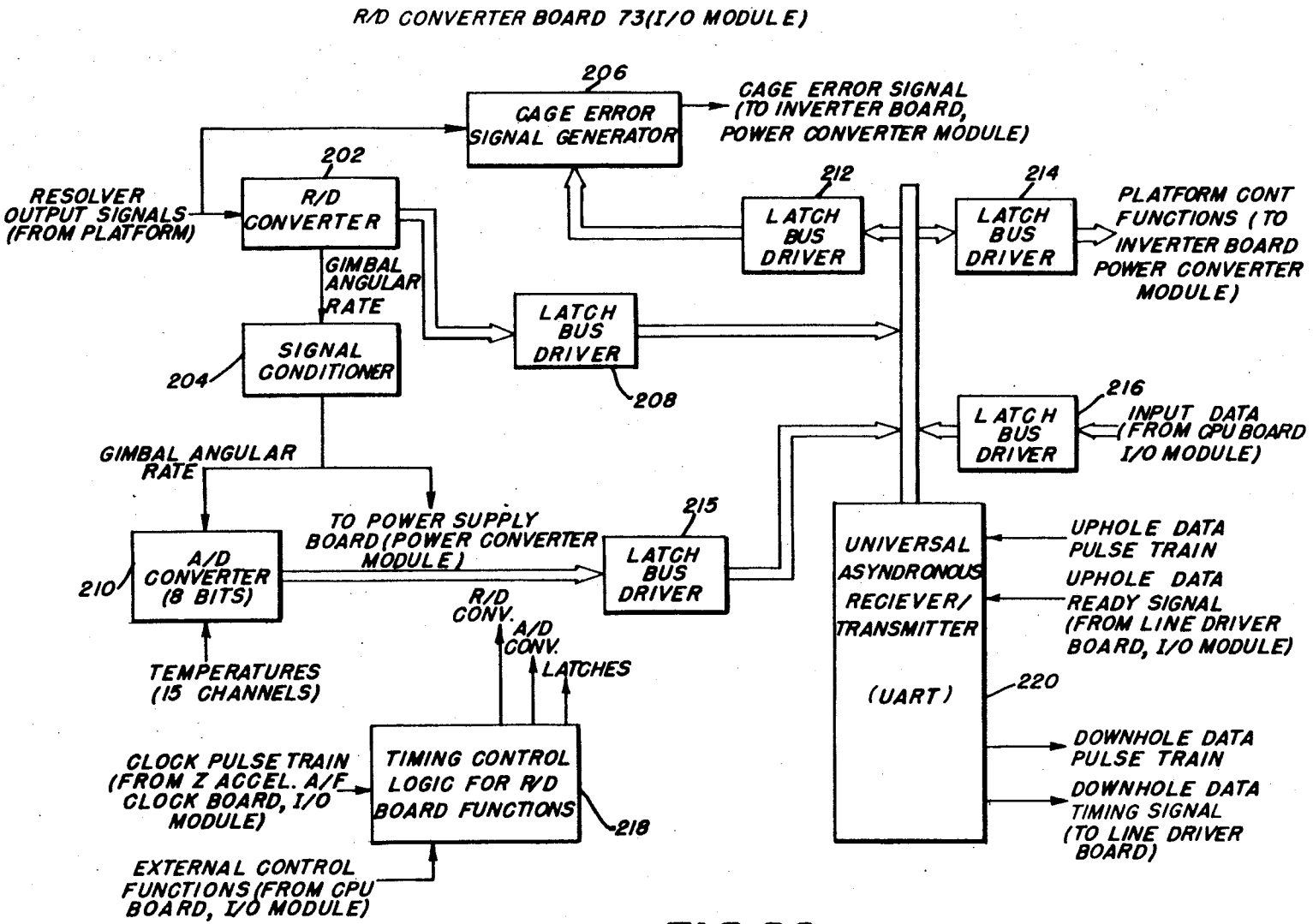
FIG. 20 is a block diagram of the Resolver-to-digital converter (R/D) Board of the system.

FIG. 20 illustrates the resolver/digital board 73 of the input/output module 12. The resolver/digital board 73 receives A.C. signals from the resolver 50 of FIG. 3 of the present application. The resolver output signal from this resolver 50 is received by a resolver-to-digital converter 202 which converts the A.C. signals supplied by the resolver into a binary word indicative of angular position and an analog voltage indicative of angular rate. The resolver/digital converter 202 applies a binary word indicative of gimbal angular position to a latch/bus driver 208 which presents the information to a universal asynchronous receiver/transmitter (UART) 220. The resolver/digital converter 202 also provides an analog signal indicative of angular rate to a signal conditioner 204 which converts the gimbal angular rate into a 0–5 volt analog signal which is applied to a analog/digital converter 210 which converts this angular rate to a digital signal which is applied to the UART 220 via a latch/bus driver 215. The analog/digital converter 210 further receives analog temperature data indicative of temperatures within the instrument and transfers these temperatures to the UART for later transmission uphole.

The gimbal angular rate signal produced by the signal conditioner 204 is also applied to the power supply board 80 within the power converter 18. The function of this gimbal angular rate signal supplied to the power supply board 80 will be later described in reference to FIG. 18.

The resolver output signal from resolver 50 is also applied to a cage error signal generator 206 which produces a cage error signal (to be later described) which is applied to the gimbal caging servo portion of the inverter board as disclosed in FIG. 17. The cage error signal generator 206 also receives an angular command, when in operation, from a latch/bus driver 212 which presents the command to the cage error signal generator 206 from the UART 220. This signal is provided from uphole and serves to command the gimbal caging servo to rotate the platform to a certain angle in order to calibrate the system. This information is provided to the gimbal caging servo of the inverter board via latch-/bus driver 214.

The universal asynchronous receiver/transmitter UART 220 receives the data from the resolver/digital board and from the CPU board of FIG. 24 (to be later described) and converts this data into a serial data stream containing words of 125 bits each which will be transmitted uphole 32 times per second for a data rate of 4K bits per second. Each word contains 20 bits for each of three gyro channels, 10 bits for each of the three accelerometer channels, 10 bits for resolver information, 10 bits for one or two of the fifteen temperature channels, and 5 bits for spacing. The redundant $X_R$ gyro channel does not present information into the data stream for transmission uphole. Since 20 bits are required for one set of accelerometer or resolver data, two cycles are required to complete transmission of one set of data from these items.

Thus, the resultant data transmission rate is 32 hertz for gyro data, 16 hertz for accelerometer and gimbal resolver rate data, and 4 hertz for complete temperature data. A faster gyro data rate is desirable because attitude calculation rate is a limiting factor in accuracy in a dynamic environment.

The dedication of 20 bits to each gyro or accelerometer channel is somewhat conservative in that, at the full scale A/F pulse rate of 65kHz, only about two thousand pulses are accumulated in 1/32 of a second. Since the UART 220 operates with 8 bit words (+2 for overhead), 20 bits in the data stream are required to send 10 bits of data. If more efficient use of space is required, the data may be arranged somewhat more efficiently at the cost of an increase in complexity for the uphole microprocessor software, as later described.

Referring to FIG. 24, the central processing unit board 74 of the input/output electronics module 12 is illustrated. The central processing unit board 74 receives information from the A/F counter circuit portion of the input/output electronics module 12 of the present invention. Information is received by a latch-/bus driver 212 and is presented to a CPU 202, random access memory RAM 204 and programmable read only memory PROM 206 via a data bus 213. The microprocessor software controls the data handling within the system including the sequence in timing of the data applied to the UART 220 of FIG. 20. The data handling performed by the central processing unit 202 and its associated structure is done according to techniques known to those of ordinary skill in the art. Information stored within the memories, PROM 206 and RAM 204, is applied via a memory access bus 207 to a data latch 208 which controls the presentation of this information to a decoder 210, latch/bus driver 214 and a timing and control logic circuit 216. The decoder 210 applies information to the UART 220 of the resolver/digital board of FIG. 20 and to the A/F counter circuit portion of the input/output module 12 as shown in FIG. 21. Address data is provided via the latch/ bus driver 214 to the latch decoder 405 of FIG. 21. Further, the timing, control logic circuit 216 receives information from the clock 375 of FIG. 14 and from the interrupt generator 402 of FIG. 21 in order to time the transferred information within the CPU board 74. The CPU 202 and its associated memories also present information to the universal asynchronous receiver/transmitter UART 220 of the resolver/digital board 13 via the latch/bus driver 212.

Figure 17:
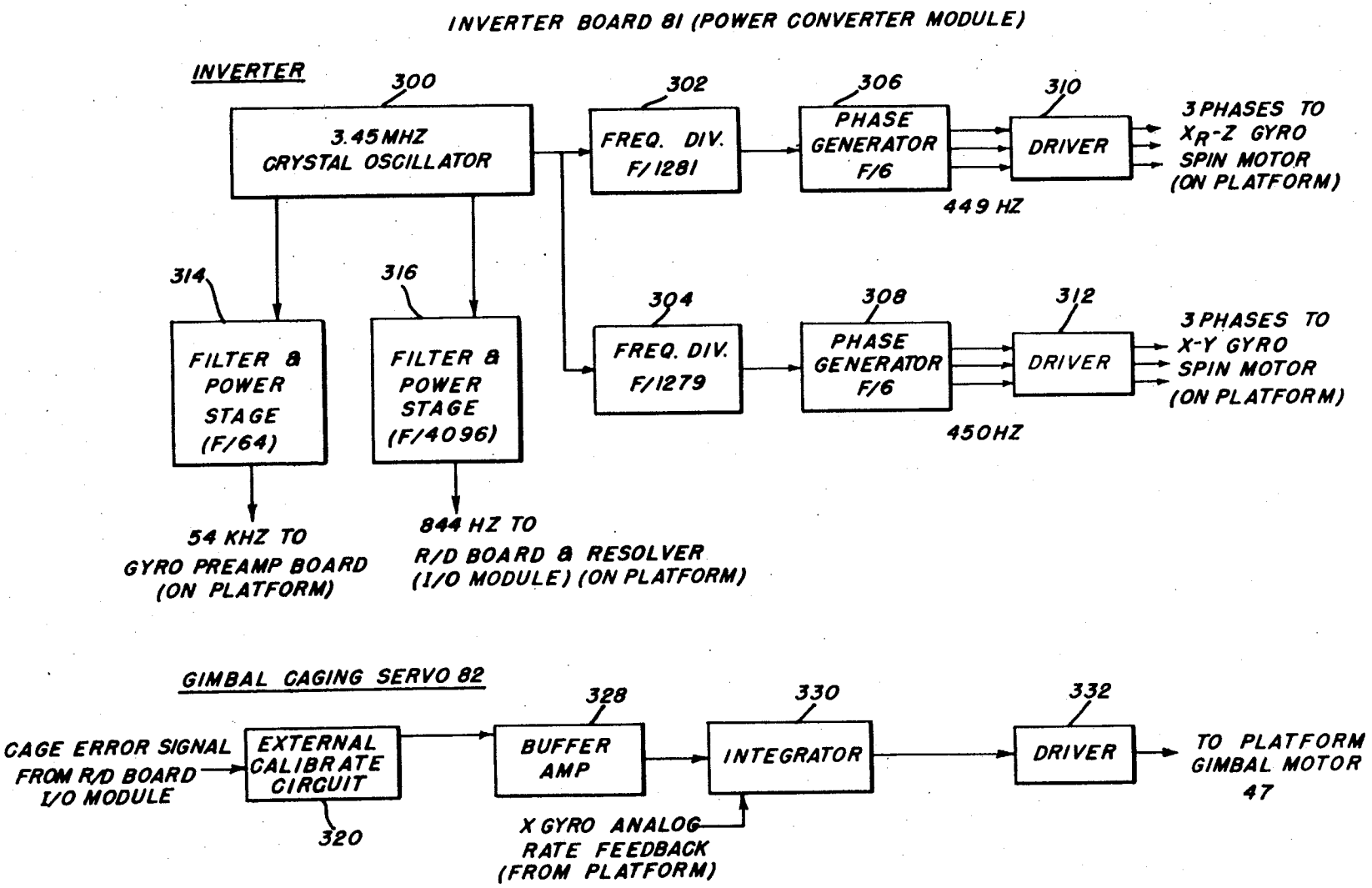
FIG. 17 is a block diagram of the Inverter Board of the system.

FIG. 17 illustrates the inverter board 81 which includes a 3.5MHV crystal oscillator 300 which produces a high frequency which is supplied to a frequency divider 302, frequency divider 304, filter and power stage divider 314, and filter and power stage divider 316. The filter and power stage divider 314 supplies a 54 kilohertz A.C. signal for the gyro pickoffs while the filter and power stage divider 316 supplies an 844 hz A.C. waveform to the resolver for resolver excitation. The outputs of the respective frequency dividers 302, 304 are supplied to associated phase generators 306, 308 which produce three phase A.C. to the $X_R$-Z gyro spin motor and X-Y gyro spin motors, respectively, through first and second drivers 310, 312.

The gimbal caging servo is also located on the inverter board 81. The gimbal caging servo includes an external calibrate circuit which receives external commands and information from the cage error signal generator 206 of the resolver/digital board 13 of FIG. 20. This cage error signal is applied to the external calibrate circuit and is used to recalibrate the system when desired. This calibration can be done, as desired, according to methods common to the art at any time and travel through the borehole may be stopped, if necessary. The commands from the external calibrate circuit 320 are applied to a buffer amplifier 328 which in turn applies the commands to an integrator 330 and driver 332 to the platform gimbal motor 47. When the system is in an operational mode and not being calibrated, X gyro analog rate feedback is received from the X gyro angular rate sensor and is applied to the integrator 330 and driver 332 in order to control the platform gimbal motor 47 to prevent the rotation of the platform 16 caused by cable twist from the action of borehole fluids or tool centralizers as the tool is raised or lowered in the borehole.

When the external calibrate circuit 320 is being operated, the platform may be caged so as to rotate to a predetermined position by the external calibrate control. A caged error signal consisting of a voltage which represents the difference between the commanded and actual gimbal position is filtered, demodulated, integrated and fed to the platform gimbal motor 47 along with with rate feedback from the X gyroscope. The motor rotates the gimbal until the platform is at the predetermined position and the cage error signal is zero.

Figure 19:
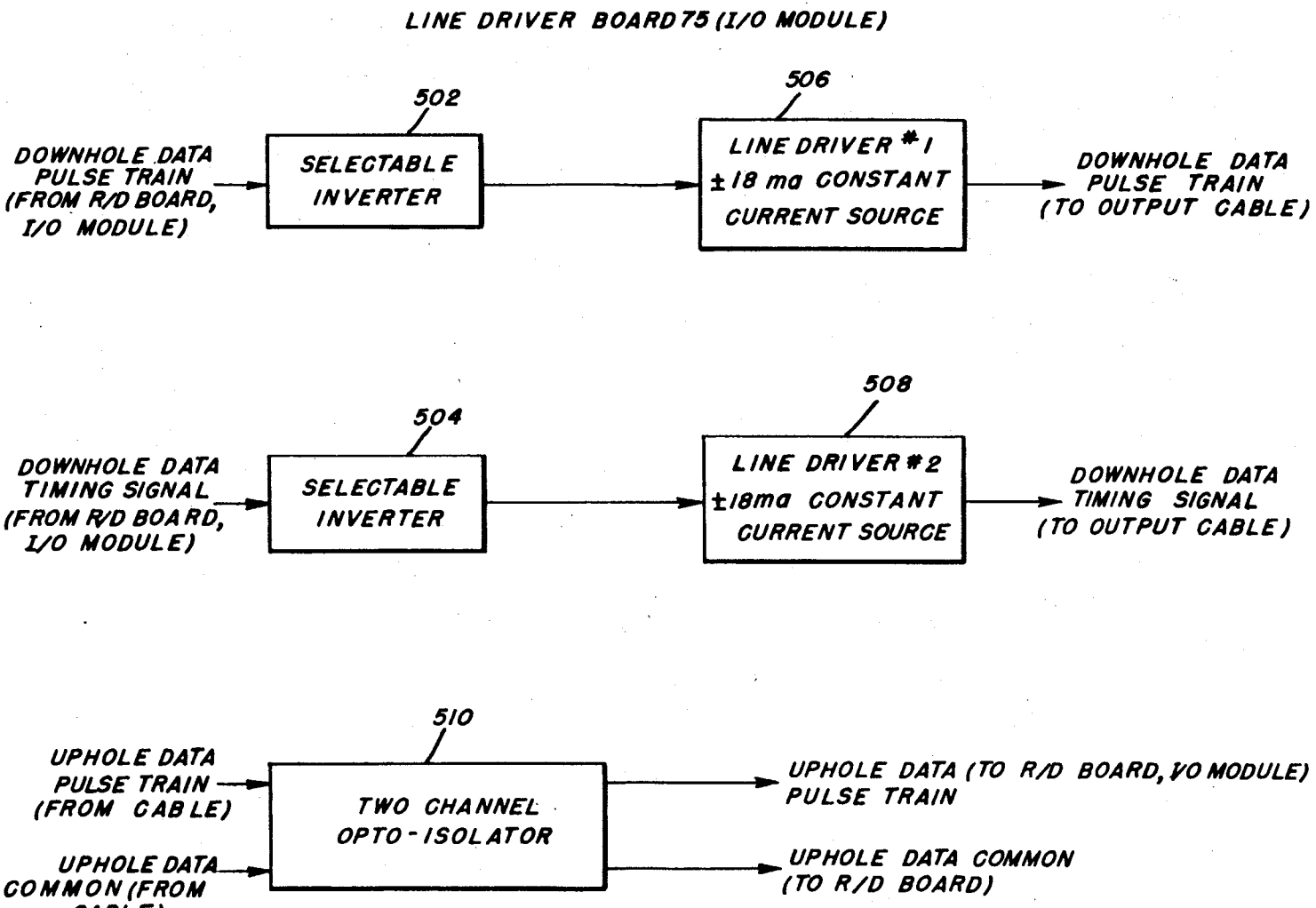
FIG. 19 is a block diagram of the Line Driver Board of the system.

The cable 17 which connects the wellbore inertial navigation system to the computer 19 positioned uphole includes seven conductors. Five conductors of the seven in the cable are occupied with data transmission. These include an uphole data line, an uphole common line, a downhole data line, a downhole common line, and a downhole data timing line. Referring to FIG. 19, on the line driver board 75 of the input/output module 13, the downhole data and timing lines are each presented to a selectable inverter 502, 504 which produce the proper pulse polarity. These selectable inverters 502, 504 are followed by current sources 506, 508 which convert the voltage pulses to current pulses on the cable. Data from uphole is run through a two channel opto-isolator 510 which consists of a pair of photodiodes and photocells. Eliminating the direct electrical connection between the uphole computer and the downhole UART results in the reduction of noise in the system.

The downhole data timing line carries a current which alternates between 0 and 20 milliamps at a frequency of 32 HZ. The purpose of this timing signal is to provide the uphole computer with a means of synchronizing on the downhole data.

The universal asynchronous receiver/transmitter 220 of FIG. 20 and its associated line driver circuit including selectable inverters 502, 504 and line drivers 506, 508 are identical to similar items located uphole at the other end of the cable and adapted to send and receive signals in a similar manner. In addition to the uphole data, downhole data, and downhole data timing lines, the seven conductors of the cable include an uphole common line, a downhole common line, a master power switching line, and one spare line.

Figure 25:
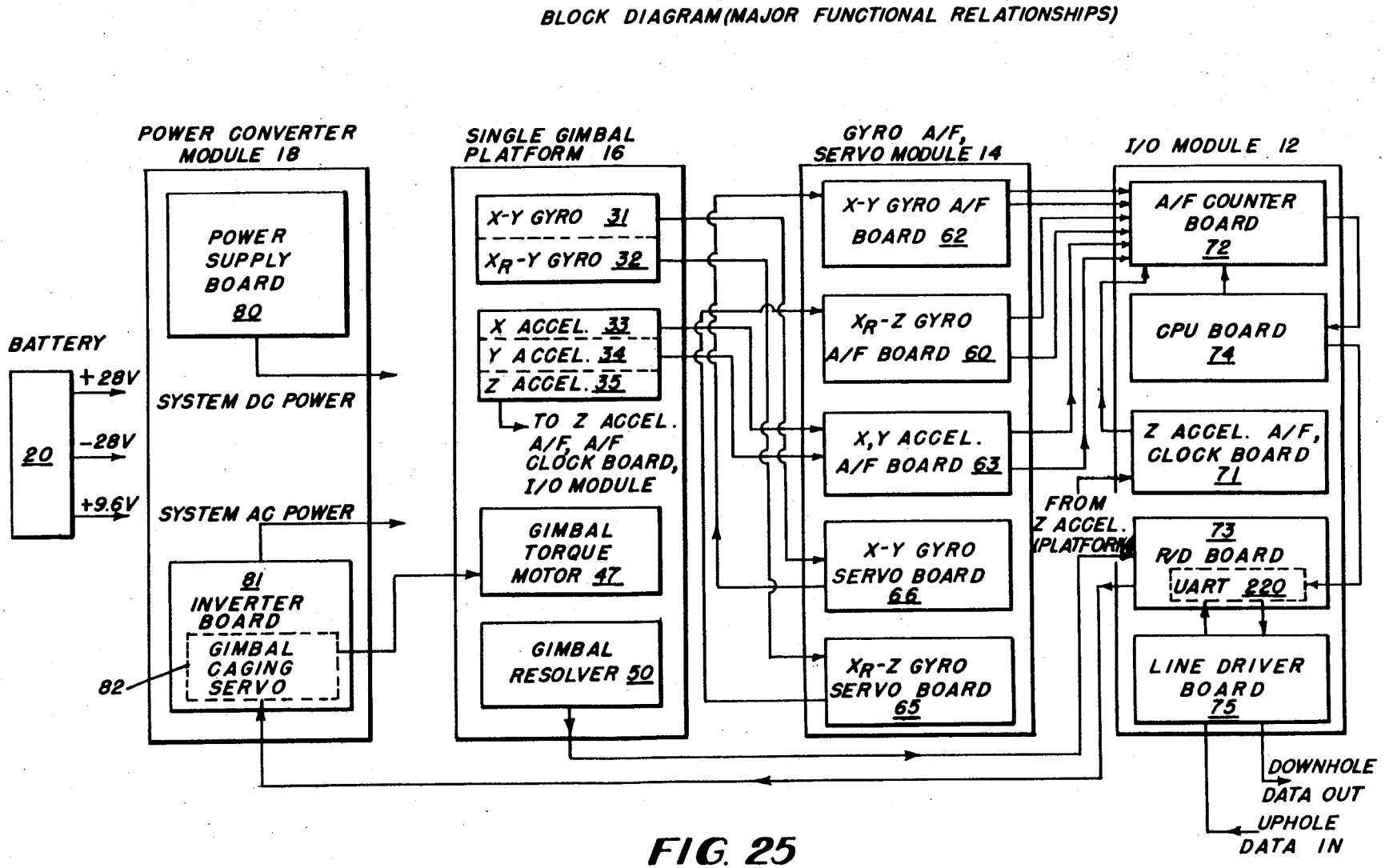
FIG. 25 is a block diagram of the assembly of the various assemblies of the wellbore inertial surveying system.

FIG. 25 illustrates a block diagram of the functional relationship between the major components of the device of the present invention. As all these components and their individual relationship with other components in the system have been described previously, it is unnecessary to describe this Figure in detail. However, the overview provided by FIG. 25 is valuable in understanding the operation of the device of the present invention as will be now described.

BRIEF DESCRIPTION OF OPERATION

The operation of the system of the present invention will now be described with reference to the drawings of the present application and with particular explanation of FIGS. 12 and 13 of the drawings which illustrate flow charts representative of programs used by the system of the present invention.

In operation, the inertial navigation system of the present invention is lowered into a borehole by a cable 17 which both physically and electrically connects the navigation system of the present invention to the surface equipment. A computer positioned on the surface communicates with the downhole surveying system. The sensor block mounted on the single gimbal platform is stabilized against rotation about the tool axis through a feedback loop which monitors rate feedback produced by the X axis of the X–Y gyro 31 to seek to eliminate rotation of the sensing system about the X axis. Thus, the platform 16 prevents the rotation of the sensor block relative to the borehole despite rotation of the tool caused by the wind up of the downhole equipment on the cable 17 caused by a variety of factors already mentioned.

As the system is on a single gimbal and only partially strapped-down, large incremental changes in angular rate are prevented and angular rate changes and linear acceleration may be measured with greater accuracy.

To initialize the downhole system prior to surveying, the survey tool is held motionless at the surface for approximately 15 minutes to normalize gyroscopic measurements caused by the earth's rotation and accelerometer measurements caused by gravity. The tool is then quickly lowered into the hole to begin surveying. During surveying, the system is periodically brought to rest for a calibration consisting of a measurement of the velocity calculation error and estimation of survey errors.

Periodically during surveying, the attitude of the surveying tool is calculated in the form of a direction cosine matrix based upon gyro outputs, and used to convert accelerometer outputs to a known coordinate frame, that is, down, east and north. Again referring to FIG. 12, the uphole computer 19 uses the gyro and accelerometer data to calculate the tools' attitude as well as the position and velocity of the tool in the borehole. The algorithm implemented by the computer 19 consists of two major parts.

The survey algorithm is a modification of a strapped-down inertial navigation algorithm, in which the angular rate of the sensor block about the X axis is nearly zero. The algorithm is executed periodically at a predetermined rate as inertial data is available from the downhole universal asynchronous receiver/transmitter 220. After each sample, the attitude or velocity and position are updated. When attitude is computed, a direction cosine matrix is updated using the gyro data produced by the downhole tool. The updated direction cosine matrix is then used during the following sampling period to transform accelerometer data to the survey coordinate system of down, east and north. This transformed acceleration data is used to calculate velocity and position in a known manner. Several additional computations are executed at a submultiple of the main sampling rate as shown at the bottom of FIG. 12. For example, ortho-normalization may be performed in order to assure that the direction cosine matrices have perpendicular axis characteristics. Alternatively, the gravity model might be modified in order to compensate for the depth of the inhole tool. This is necessary because the force of gravity changes with the earth's radius.

Figure 12:
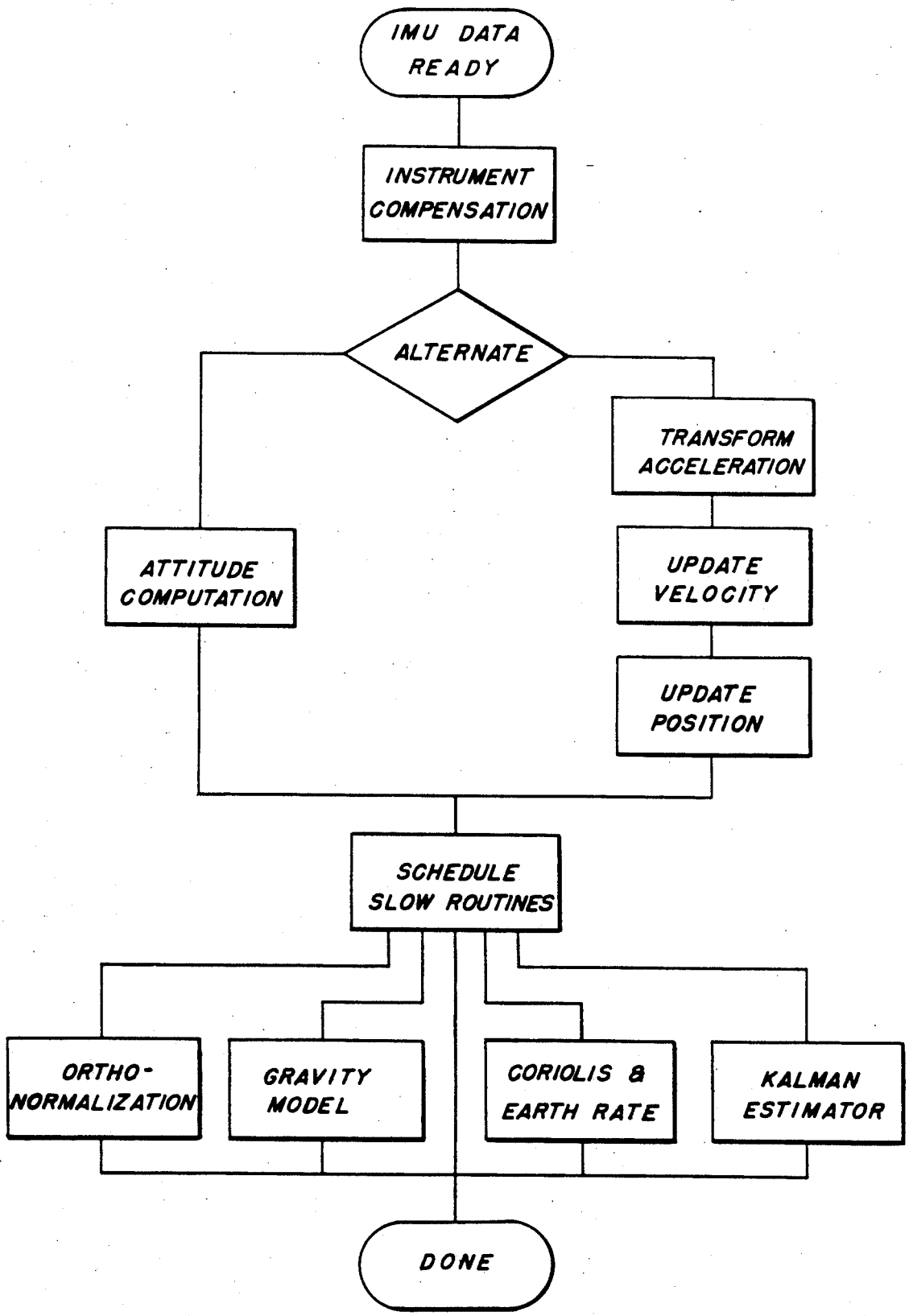
FIG. 12 is a flow chart of the Surveying Algorithms.

Periodically, the coriolis and earth rate subroutine of the algorithm of FIG. 12 compensates the gyros and accelerometers for the earth's rotation. Also, a Kalman Estimator periodically deduces a minimum error estimate of the state of the system by utilizing knowledge of the system dynamics, assumed static and system noises and measurement errors and initial condition information. This technique is used to estimate errors within the survey system of the present invention.

Figure 13:
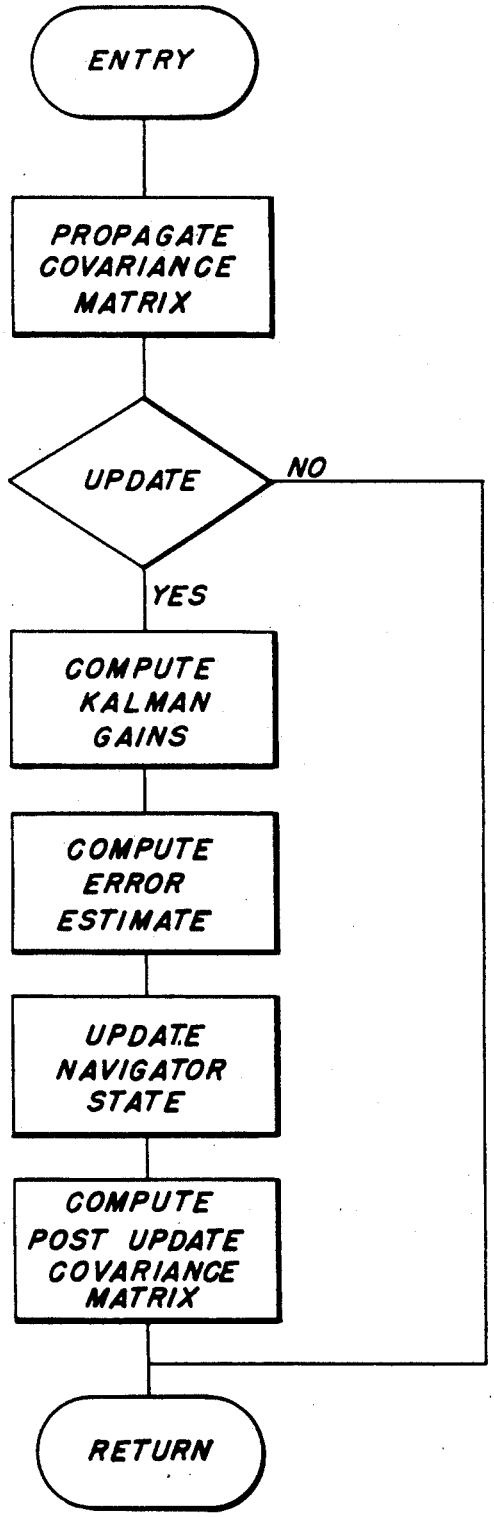
FIG. 13 is a flow chart of the Kalman Estimator Algorithm.

FIG. 13 illustrates a flow chart of algorithms used by the computer 19 of the present invention for generating Kalman estimates.

The Kalman Filter is a particular form of an optimal estimator for linear systems. An optimal estimator is a computational algorithm that processes measurements to deduce a minimum (in some well-defined sense) error estimate of the state of a system by utilizing knowledge of the system dynamics, statistics, and initial conditions.

Linear System Description

The system state vector $\underline{X}$ at the time $t_k$ is given by $$\underline{X}_K = \Phi_{K-1}\underline{X}_{K-1} + \underline{W}_{K-1}\text{A}.$$

$\underline{w}$K is a zero mean, white noise sequence of covariance $Q_k$. Thus, the state vector at any time $t_k$ is a linear function of the state vector at the previous time $t_{k-1}$, plus system noise. $\Phi$ is known as the state transition matrix.

Measurements are taken at $t_k$ and can be represented as $$\underline{Z}_K = H_K\underline{X}_K + \underline{v}_K\text{B}.$$

$\underline{Z}_K$ is a vector representing measured linear combinations of the system state variables, plus measurement noise, represented by the vector $\underline{v}_K$ (of covariance $R_K$).

$H_K$ is the measurement matrix at time $t_k$; it describes the linear combinations of state variables $\underline{X}_K$ which compromise $\underline{Z}_K$ in the absence of noise. The problem solved by the Kalman filter is how to combine the measurement information $Z_K$ with existing estimates of the system states, $\hat{\underline{X}}_K$, to produce new state estimates $\hat{\underline{X}}_K$ (+). The plus sign denotes the estimate after the measurements are taken into account.

One may seek a new estimate of the system state vector $\hat{\underline{X}}$ of the form $$\hat{\underline{X}}_K(+)=\hat{\underline{X}}_K+K_k[\underline{Z}_K-H_K\hat{\underline{X}}_K]\text{C.}$$

where $\hat{\underline{X}}_K(+)$ is the new estimate of the system state vector, $\hat{\underline{X}}_K$ is the old (pre-measurement) estimate, and $\underline{Z}_K$ and $\underline{H}_K$ were previously defined.

$\underline{Z}_K-H_K\hat{\underline{X}}_K$ will be non-zero due to the presence of noise.

$K_K$ is a gain matrix to be chosen to minimize the error in the estimate $\hat{\underline{X}}_K(+)$.

When $K_K$ is so chosen, it is called the Kalman gain matrix.

Let $\underline{e}_K=\hat{X}_K-\underline{X}_K$, the error in the estimate.

Define $P_K=E\{\underline{e}_K\ \underline{e}_K T\}$=error covariance matrix where $\underline{e}_K T$ represents the transpose of $\underline{e}_K$.

If you choose $K_K$ in equation C by use of equation D, the magnitude of the error vector ($\underline{e}_K$) will be minimized.

$$K_K=P_KH_K^T[H_KP_KH_K^T+R_K]^{-1}$$

$$\text{where } P_K = \Phi_{K-1}\,P_{K-1}\,\Phi_{K-1}^T + Q_{K-1} \qquad \text{E.}$$

Again, $P_K$ is the error covariance matrix,
$\Phi$ is the state transition matrix,
and $Q_K$ is the system or process noise covariance.

According to the teachings of the present invention, the application of Kalman filtering to the wellbore mapping problem is dependent on the existence of a linearized error model for an inertial navigator. The model equation is $$^{dt}[\underline{\delta x}(t)]=F(\underline{X},t)\underline{\delta x}(t)+G(t)\underline{U}(t)$$

$\underline{\delta X}$ is a vector with elements and units as shown in Table 1. Note that these elements are system errors.

F. is a matrix as given in Tables 2A, 2B, and 2C. Its elements are continuously updated from outputs of the navigation part of the software. The $C^n{}_p$ matrix is a transformation calculated as part of well-known inertial navigation calculations. $G(t)\underline{U}(t)$ is a driving or input function.

$$G(t) = \begin{bmatrix} 0_{9\times 6} \\ \hline I_{6\times 6} \end{bmatrix}$$

$\underline{U}(t)$ is a vector, the six elements of which are random noise associated with the random bias changes of the inertial instruments (gyros and accelerometers).

Equation F. allows the calculation of the response of the inertial navigation system to these errors. The variances associated with $\underline{U}(t)$ are used in the calculation of the process noise matrix, $Q_K$, as demonstrated later.

Update Calculation Procedure

The state transition matrix $\Phi$ is related to G. the F matrix (as defined above) by $\dot{\Phi}=F\Phi$.

As the survey calculations procede in the uphole computer, F is updated from the outputs of the navigation calculations. The an updated value of $\Phi$ is obtained by integration of equation G.

The states of this estimation problem are the errors $\underline{\Phi x}$.

With each new value of $\Phi$ new estimates of $\underline{\Phi x}$, and $P_K$ are calculated by the uphole computer.

$$\hat{\underline{\delta x}}_k = \Phi_{k-1}\,\hat{\underline{\delta x}}_{k-1} \qquad \text{H.}$$

$$P_K = \Phi_{k-1}P_{k-1}\,\Phi_{x-1}^T + Q_{k-1}$$

$Q_K$ is a covariance matrix associated with the accelerometer and gyro bias errors. It will be discussed in more detail later.

Every minute or so, the tool is brought to a stop. At these times, the tool velocity is assumed to be zero. Therefore, any calculated velocities are direct estimates of velocity errors. The measurements equation is $$\underline{Z}_K = H_K\,\underline{\delta x}_k + \underline{V}_K \qquad \text{I.}$$

$$H_K = \left[\begin{array}{c|c|c} 0_{3\times 3} & I_{3\times 3} & 0_{3\times 9} \end{array}\right]$$

$H_K$ is a "selection" matrix which simply serves the measurement to the three velocities only. These three velocities in the preferred embodiment are North, East and down. All other terms are zero. $\underline{v}_K$ is a measurement noise sequence of assumed covariance $R_K$. $R_K$ will be discussed later.

The measured velocity errors $Z_K$ (calculated when the system is at rest) are used to update (or correct) the tool navigation parameters as follows. Recall that $P_K$ and $\delta X_K$ are available as a consequence of the navigation and covariance propagation calculations by the surface computer. The Kalman gain may be calculated from $$K_K=P_KH^T{}_K[H_KP_KH^T{}_K+R_K]^{-1}$$

Next, the updated estimate of the states $\hat{\underline{\delta X}}(+)$ is calculated by the computer.

$$\hat{\underline{\delta X}}(+)=\hat{\underline{\delta X}}+K_K[Z_K-H_K\hat{\underline{\delta X}}_K]\text{C. Also,}$$

$$P_K(+)=[I-K_KH_K]P_K$$

These states $\underline{\delta X}$ are errors in the tool navigation parameters, i.e., errors in displacements, velocities, attitude angles, and accelerometer and gyro biases.

When the updated state vector estimate $\hat{\underline{\delta X}}(+)$ is obtained, it is used to calculate corrected estimates $\hat{\underline{X}}$ (of tool displacement, velocity, attitude) by $$\hat{\underline{X}}_K(+)=\hat{X}_K-\hat{\underline{\delta X}}_K(+)$$

where $\hat{\underline{\delta X}}_K(+)$ is $\delta X_K$ after measurements are taken into account.

Even thou $\underline{Z}_K$ consists only of velocity error measurements (a total of 3), all 15 states ($\underline{X}_K$) are corrected by this procedure. This is a consequence of the gain matrix $K_K$ generally having all non-zero elements. In other words, the measured velocity errors $\underline{Z}_K$ are functionally related to other system states by the nature of the F matrix and therefore the $\Phi$ and P matrices.

Noise Covariance Matrices $Q_K$ and $R_K$

Recall from equation A that the state vector $\underline{\delta X}_K$ (at time $t_K$) is related to the state vecto $\underline{\delta X}_{K-1}$ (at previous time $t_{K-1}$) by $$\underline{\delta X}_K = \delta_{K-1}\underline{\delta X}_{K-1} + \underline{W}_{K-1}$$

where $\underline{W}_K$ is a zero mean, white noise (or "process" noise) sequence of covariance $Q_K$.

$Q_K$ appears as an add-on in the equation for the propogation of P.

$$P_K = \Phi_{K-1}P_{K-1}\Phi^T_{K-1} + Q_{K-1} \qquad \text{H.}$$

$Q_K$ is obtained by integrating the following equation.

$$Q_K = \int_{t_{k-1}}^{t_k} \Phi(t_k,\tau)\, G\,(E\{\overline{UU^T}\})\, G^T\Phi^T(t_k,\tau)d\tau$$

δ, G, and $\overline{U}$ were defined earlier, $$E\{\overline{UU^T}\} = \begin{bmatrix} \alpha g^2 & & & & & \\ & \alpha g^2 & & & & \\ & & \alpha g^2 & & & \\ & & & \alpha a^2 & & \\ & & & & \alpha a^2 & \\ & & & & & \alpha a^2 \end{bmatrix} = \text{Estimated value of noise vector and its transposition}$$

The effect of the process noise $Q_K$ is to cause the diagonal elements of the covariance matrix, $P_K$, to grow linearly with time.

i.e. $\sigma^2 = a^2t + \sigma_o^2$

The α's were chosen so that these variances, which are associated with gyro and accelerometer biases, will quadruple in one hour.

$$\alpha g = 5.0 \times 10^{-9}\ \text{rd/sec}\,\frac{3}{2} \qquad \text{L.}$$

$$\alpha a = 6.6 \times 10^{-5}\ \text{ft/sec}\,\frac{5}{2}$$

These values are selected on the basis of judgement and experiment and are not critical. However, some noise input is necessary in order to prevent Kalman gains from diminishing in time. The purpose of including this process noise in the filter is to include the effects of random bias changes in the instruments and to hold the Kalman filter gains above some minimum value.

The measured velocity vector $\underline{Z}_X$ of the system states is given by $$\underline{Z}_K = H_K\underline{\delta X}_K + \underline{X}_K$$

where $\underline{V}_K$ is a zero mean, white noise (measurement noise) sequence of covariance $R_K$.

$$R_K = \begin{bmatrix} \sigma^2_{VE} & & \circ \\ & \sigma^2_{VN} & \\ \circ & & \sigma^2_{VD} \end{bmatrix}$$

where the $\sigma^2_v$'s are variances associated with making a particular velocity error measurement (when the tool is stopped). As a typical value determined by judgement and routine experimentation, $$\sigma^2_{VE} = \sigma^2_{VN} = \sigma^2_{VZ} = 0.01\ \text{ft/sec.}$$

This noise includes effects such as accelerometer quantization noise and residual motion present when the system is assumed to be at rest.

Initial Value of the Covariance Matrix, $P_K$,

In the present version of the software, the initial system errors are assumed to be uncorrelated, i.e., the offdiagonal elements of $P_K$ are zero. The covariances associated with the initial porition are assumed to be zero. This is Justified by the fact that although there may be uncertainty in the absolute location of the wellhead only the relative location of the bore with respect to the wellhead is of interest. Therefore, $$P_{11} = P_{22} = P_{33} = O.$$

Similarly for initial velocities, $$P_{44} = P_{55}P_{66} = O.$$

The initial attitude error standard deviation σ is taken to be 0.1 radian, a reasonable value for a manual prealignment of the system.

$$\text{So, } P_{77} = P_{88} = P_{99} = (.1)^2 = .01\ (rd)^2$$

The initial values of $P_{10,10}$ to $P_{15,15}$ are related to the quality of the inertial instruments. Again, bias uncertainties (deviations) of 0.05 degrees/hour for the gyros and 100 micro-g's for the accelerometers were assumed using Judgement and routine experimentation. In different units, $$P_{10,10} = P_{11,11} = P_{12,12} = 5.9 \times 10^{-14}\ (rd/sec)^2$$

$$P_{13,13} = P_{14,14} = P_{15,15} = 1.0 \times 10^{-5}\ (ft/sec^2)^2$$

TABLE I

System State Variables

| State Variable | Symbol | Description | Units |
|---|---|---|---|
| $\delta x_1$ | $\delta\lambda$ | longitude error | rad |
| $\delta x_2$ | $\delta L$ | latitude error | rad |
| $\delta x_3$ | $\delta H$ | altitude error | ft |
| $\delta x_4$ | $\delta v_E$ | East velocity error | ft/sec |
| $\delta x_5$ | $\delta v_N$ | North velocity error | ft/sec |
| $\delta x_6$ | $\delta v_Z$ | up velocity error | ft/sec |
| $\delta x_7$ | $\epsilon_E$ | East axis attitude error | rad |
| $\delta x_8$ | $\epsilon_N$ | North axis attitude error | rad |
| $\delta x_9$ | $\epsilon_z$ | up axis attitude error | rad |
| $\delta x_{10}$ | $\Delta GB_x$ | x gyro bias error | rad/sec |
| $\delta x_{11}$ | $\Delta GB_y$ | y gyro bias error | rad/sec |
| $\delta x_{12}$ | $\Delta GB_z$ | z gyro bias error | rad/sec |
| $\delta x_{13}$ | $\Delta AB_x$ | x accelerometer bias error | ft/sec$^2$ |
| $\delta x_{14}$ | $\Delta AB_y$ | y accelerometer bias error | ft/sec$^2$ |
| $\delta x_{15}$ | $\Delta AB_z$ | z accelerometer bias error | ft/sec$^2$ |

TABLE 2-A

Linear System Matrix Used in Error Model $F_{15\times15}$ $$\begin{bmatrix} & & 0_{3\times6} \\ F_{9\times9} & 0_{3\times3} & C_P^N \\ & C_P^N & 0_{3\times3} \\ & 0_{6\times15} & \end{bmatrix}$$

$C_p^N$ = Transformation from platform to navigation coordinates

TABLE 2-B $F_{9\times9}$ of FIG. 2-A

| | | | | | | | | |
|---|---|---|---|---|---|---|---|---|
| 0 | $\rho_z/\cos L$ | $-\rho_n/R\cos L$ | $1/R\cos L$ | 0 | 0 | 0 | 0 | 0 |
| 0 | 0 | $\rho_e/R$ | 0 | $1/R$ | 0 | 0 | 0 | 0 |
| 0 | 0 | 0 | 0 | 0 | 1 | 0 | 0 | 0 |
| 0 | $F_{42}$ | $F_{43}$ | $F_{44}$ | $(\omega_z+\Omega_z)$ | $-(\omega_n+\Omega_n)$ | 0 | $-f_z$ | $f_n$ |
| 0 | $F_{52}$ | $F_{53}$ | $-2\omega_z$ | $-k_z$ | $\rho_e$ | $f_z$ | 0 | $-f_e$ |
| 0 | $-2\Omega_z v_e$ | $F_{63}$ | $2\omega_n$ | $-2\rho_e$ | 0 | $-f_n$ | $f_e$ | 0 |
| 0 | 0 | $-\rho_e/R$ | 0 | $-1/R$ | 0 | 0 | $\omega_z$ | $-\omega_n$ |
| 0 | $-\Omega_z$ | $-\rho_n/R$ | $1/R$ | 0 | 0 | $-\omega_z$ | 0 | $\omega_n$ |
| 0 | $F_{92}$ | $-\rho_z/R$ | $\tan L/R$ | 0 | 0 | $\omega_n$ | $-\omega_e$ | 0 |

TABLE 2-C

Elements of $F_{9\times9}$

| | |
|---|---|
| $L$ | Latitude of vehicle |
| $\Omega$ | Earth rotation rate |
| $R$ | Earth radius |
| $g$ | Magnitude of gravity vector |
| $v_e, v_n, v_z$ | Components of vehicle velocity with respect to earth |
| $f_e, f_n, f_z$ | Components of specific force |
| $\Omega_n = \Omega\cos L$, $\Omega_z = \Omega\sin L$ | Components of earth rate |
| $\rho_e = -v_n/R$, $\rho_n = v_e/R$, $\rho_z = v_e\tan L/R$ | Components of angular velocity of E-N-Z frame with respect to earth |
| $\omega_e = \rho_e$, $\omega_n = \rho_n + \Omega_n$, $\omega_z = \rho_z\Omega_z$ | Components of angular velocity of E-N-Z frame with respect to inertial space |
| $k_z = v_z/R$ | |
| $F_{42} = 2(\Omega_n v_n + \Omega_z v_z) + \rho_n v_n/\cos^2 L$ | |
| $F_{43} = \rho_z\rho_e + \rho_n k_z$ | |
| $F_{44} = -\rho_e\tan L - k_z$ | |
| $F_{52} = -2\Omega_n v_e - \rho_n v_e/\cos^2 L$ | |
| $F_{53} = \rho_n\rho_z - \rho_e k_z$ | |
| $F_{63} = 2g/R - (\rho^2{}_n + \rho^2{}_e)$ | |
| $F_{92} = \omega_n + \rho_z\tan L$ | |

In the preferred embodiment, the present invention utilizes a Data General Eclipse minicomputer as the uphole computer. However, any processing system suitable for this application may be utilized, including a variety of relatively fast microprocessors. To summarize the operation of the uphole computer and the generation of Kalman Estimates, the above-discussed mathematical operations will be correlated to the flow chart of FIG. 13.

When the Kalman Estimation sub routine illustrated in FIG. 13 is entered, the state transition matrix is known from the navigational calculations which produce the matrix of Table 2-B and from solution of equation G. Further, the selection matrix $H_K$ is known, as are the noise covariance matrices $Q_K$, $R_K$, Also, known are the initial values of the error covariance matrix $P_K$ and the state errors $\underline{\delta x}_k$. As the sub-routine is initiated, the covariance matrix $P_K$ is repropagated, and new estimates of the error $\underline{\delta x}_k$ are made, utilizing the above-discussed equations H. Every minute or so, the velocity error values are updated by bringing the tool to a stop within the borehole. When this update is to take place, the Kalman gains are recalculated by the computers to the solution of equation D, $K_K = P_K H_K{}^T[H_K P_K H_K{}^T + R_K]^{-1}$.

At this time, the tool is stopped in the borehole and measurements $Z_K$ are made. As the true velocity is zero, $Z_K$ may easily be calculated from a direct measurement of the velocity errors.

Note that the tool need only be stopped for a moment in order to measure these velocity errors. This is important as important savings and downhole time are produced, thereby reducing the time during which productive drilling is impossible. The reduction in tool downhole time also reduces the exposure time of the tool to the high temperatures present in deep and/or hot boreholes.

The uphole computer then calculates an estimate of the error states $\underline{\delta x}_K(+)$ by the use of equation C, discussed above. Note that the Kalman gain matrix $K_K$, the measured velocity errors $\underline{Z}_K$, the selection matrix $H_K$, and the previous error estimate $\underline{\delta X}_K$ are all known. The uphole computer then updates the navigator states through the use of equation J, discussed above, $\hat{\underline{X}}_K(+) = \hat{\underline{X}}_K = \underline{\delta X}_K(+)$, to produce corrected estimates $\underline{X}$ of tool displacement, velocity, attitude, etc. Then, before returning to the navigational program of FIG. 12, the covariance matrix $P_K$ is updated through the use of the following equation $P_K(+) = [I - K_K H_K]P_K$. This equation produces the optimized value for the update estimation error covariance matrix $P_K(+)$.

The computer then returns to the survey program of FIG. 12, the system errors having been optimally estimated, and system states corrected, by Kalman estimation techniques.

As previously described, the gyroscopic angular rate data and accelerometer data are gathered by the downhole system and are presented in a data stream to the uphole computer by the universal asynchronous receiver/transmitter 220. It is this data that is used by the uphole computer for the calculation of the attitude through updating the direction cosine matrix. The updated attitude is then used to calculate velocity and position using the accelerometer data transformed by the direction cosine matrix.

To further support the present specification's description of the operation of the computer 19, attached hereto as Appendix 1 is a copy of a program used by the downhole microprocessor 202 and as Appendix 2 the program used by the computer 19 as a preferred embodiment.

By virtue of the present invention's system for inertially surveying boreholes utilizing Kalman optimal estimation techniques for predicting system errors, the device of the present invention may survey boreholes at high rates of approximately 500 Ft/min. These high rates of survey are in part due to the short stops required to determine system error (on the order to 8 seconds). The fast surveying rates obtained with the device of the present invention shorten drilling downtimes and reduce the susceptibility of the device to thermal buildings and overheating caused by surveying long and/or hot wellbores.

The invention being thus described, it will be apparent that numerous modifications and alterations of the system of the present invention may be made as it would occur to one of ordinary skill in the art without departing from the spirit and scope of the present invention as claimed in the appended claims.

What is claimed is:

1. A borehole survey apparatus comprising:

a housing;

means for selectively moving and stopping said housing along a borehole, said housing being subjected to angular rotations as a result of this movement;

angular measurement means, including a plurality of gyroscopes supported in said housing, for measuring the angular rate of rotation of said housing and producing angular signals indicative thereof;

acceleration measurement means, including a plurality of accelerometers mounted in said housing, for measuring inertial accelerations applied to said housing and producing acceleration signals indicative thereof;

single gimbal platform assembly means contained within said housing for supporting all said gyroscopes and said accelerometers, said platform assembly means having only a single axis of rotation aligned with said housing;

servo means responsive to said angular signals for preventing rotation of said platform assembly means relative to said borehole while said housing is rotating; and computing means for calculating the position of said housing within said borehole from said angular and acceleration signals and producing position information indicative thereof; and estimating system errors using Kalman estimation techniques while said housing is stopped; and modifying said position information to compensate for said estimated system errors, said position information forming a survey of said borehole.

2. The borehole survey apparatus of claim 1 further comprising means for generating calibration signals, said servo being responsive to said calibration signals to rotate said platform assembly means to a predetermined orientation relative to said borehole and hold said platform assembly means in said orientation while said housing is stopped.

3. The apparatus of claim 1 wherein said housing includes thermal insulation surrounding at least said angular measurement means and acceleration measurement means, said housing means further having a high thermal mass.

4. The apparatus of claim 1 wherein said angular signals produced by said angular measurement means are digital pulse trains, each pulse indicating an increment of angular position, the pulse rate indicating angular rate of change.

5. The apparatus of claim 4 wherein said acceleration measurement means produces, at its output, a digital pulse train, the frequency of which is indicative of linear acceleration.

6. The apparatus of claim 5 further comprising information gathering and relaying means receiving said angular and acceleration signals from said angular measurement and said acceleration measurement means and transferring said signals to said computing means, said computing means being located at the surface of said borehole, 7. The apparatus of claim 6 further comprising information receiving means located at the surface of said borehole for decoding said borehole information signal and providing the information to said computing means.

8. The apparatus of claim 7 wherein said information gathering and relaying means includes means for accumulating said digital pulse trains indicative of linear acceleration and angular rate, said accumulator means being periodically reset.

9. The apparatus of claim 7 wherein said information gathering and relaying means includes information transmission means for periodically receiving the contents of said means for accumulating and for encoding said contents to produce a borehole information signal.

10. The device of claim 7 wherein said computing means is a digital computer

11. A method of surveying a borehole comprising the steps of:

lowering an instrument having a single gimbal platform assembly supporting a plurality of gyroscopes and a plurality of accelerometers into said borehole;

measuring the angular rate of said instrument with said gyroscopes;

measuring inertial accelerations applied to said instrument with said accelerometers;

determining the calculated position of said instrument from said measured angular rate and accelerations;

selectively stopping said instrument within said borehole;

optimally estimating system errors using Kalman estimation techniques by:

rotating said platform assembly to a predetermined orientation relative to said borehole and holding said platform assembly means in said orientation while said housing is stopped; and measuring inertial accelerations applied to said instrument while said platform assembly means is held in said orientation, the measured acceleration data being used with said Kalman estimation technique;

modifying said calculated position to compensate for said estimated system errors to form corrected position information; and producing a borehole survey by compiling correct position information representative of various positions along said borehole.

* * * * *